US011739569B2

(12) United States Patent
Pilested

(10) Patent No.: US 11,739,569 B2
(45) Date of Patent: Aug. 29, 2023

(54) SYSTEM TO ISOLATE TWO MOTOR DRIVING CIRCUITS DRIVING A SINGLE MOTOR AND METHOD FOR ISOLATION

(71) Applicant: MAGNA CLOSURES INC., Newmarket (CA)

(72) Inventor: Kasper Martin Pilested, Newmarket (CA)

(73) Assignee: MAGNA CLOSURES INC., Newmarket (CA)

( * ) Notice: Subject to any disclaimer, the term of this patent is extended or adjusted under 35 U.S.C. 154(b) by 230 days.

(21) Appl. No.: 17/067,094

(22) Filed: Oct. 9, 2020

(65) Prior Publication Data

US 2021/0108449 A1 Apr. 15, 2021

Related U.S. Application Data

(60) Provisional application No. 62/966,390, filed on Jan. 27, 2020, provisional application No. 62/913,310, filed on Oct. 10, 2019.

(51) Int. Cl.
*E05B 81/14* (2014.01)
*E05B 81/20* (2014.01)
*E05B 81/56* (2014.01)

(52) U.S. Cl.
CPC ..... *E05B 81/14* (2013.01); *E05B 81/20* (2013.01); *E05B 81/56* (2013.01)

(58) Field of Classification Search
CPC ..... E05B 81/06; E05B 81/14; E05B 81/20; E05B 81/26; E05B 81/30; E05B 81/34; E05B 81/42; E05B 81/54; E05B 81/56; E05B 81/58; E05B 81/62; E05B 81/64; E05B 81/66; E05B 81/68; E05B 81/76;
(Continued)

(56) References Cited

U.S. PATENT DOCUMENTS 6,848,727 B1 2/2005 Cetnar et al.
8,474,888 B2 7/2013 Tomaszewski
(Continued)

FOREIGN PATENT DOCUMENTS

CN 109441280 A * 3/2019 ..... E05F 15/40
WO WO-2014081451 A2 * 5/2014 ..... B60R 25/01
WO WO-2017144044 A1 * 8/2017 ..... B60Q 3/267

*Primary Examiner* — Christine M Mills
*Assistant Examiner* — Christopher F Callahan
(74) *Attorney, Agent, or Firm* — Dickinson Wright PLLC

(57) ABSTRACT

An isolation system for an electric motor of an actuatable mechanism is provided. The system includes a primary motor driving circuit and a secondary motor driving circuit each coupled to the electric motor. The secondary motor driving circuit is coupled to an external motor controller configured to provide a secondary driving signal to the secondary motor driving circuit. A primary controller is coupled to the primary motor driving circuit and configured to monitor the secondary driving signal and control the primary motor driving circuit. An isolation logic unit is coupled to the primary and secondary motor driving circuits and the primary controller and the external motor controller. The isolation logic unit is configured to isolate the primary motor driving circuit from the secondary motor driving circuit in response to the external motor controller providing the secondary driving signal to the secondary motor driving circuit.

10 Claims, 19 Drawing Sheets

(58) Field of Classification Search
CPC ..... E05B 81/80; Y10T 292/1047; Y10T 292/1082; Y10S 292/23
See application file for complete search history.

(56) References Cited

U.S. PATENT DOCUMENTS

| | | | | |
|---|---|---|---|---|
| 10,294,699 | B2 | 5/2019 | Kowalewski et al. | |
| 10,329,807 | B2 | 6/2019 | Margheritti et al. | |
| 10,378,251 | B2 | 8/2019 | Dente et al. | |
| 10,428,560 | B2 | 10/2019 | Dente et al. | |
| 10,655,368 | B2 | 5/2020 | Frello et al. | |
| 2006/0290518 | A1 | 12/2006 | Bingle et al. | |
| 2017/0089103 | A1 | 3/2017 | Ottino et al. | |
| 2017/0089104 | A1* | 3/2017 | Kowalewski | E05B 81/82 |
| 2017/0107747 | A1 | 4/2017 | Dente et al. | |
| 2018/0340359 | A1 | 11/2018 | Cumbo | |
| 2018/0355642 | A1 | 12/2018 | Cumbo et al. | |
| 2018/0355643 | A1* | 12/2018 | Taurasi | E05B 81/16 |
| 2019/0063117 | A1 | 2/2019 | Mozola | |
| 2019/0136590 | A1 | 5/2019 | Patane et al. | |
| 2019/0161996 | A1 | 5/2019 | Taurasi et al. | |
| 2019/0271180 | A1 | 9/2019 | Sardelli et al. | |
| 2019/0309564 | A1 | 10/2019 | Mitchell et al. | |
| 2020/0080350 | A1 | 3/2020 | Tomaszewski et al. | |
| 2020/0095809 | A1 | 3/2020 | Yong | |

* cited by examiner

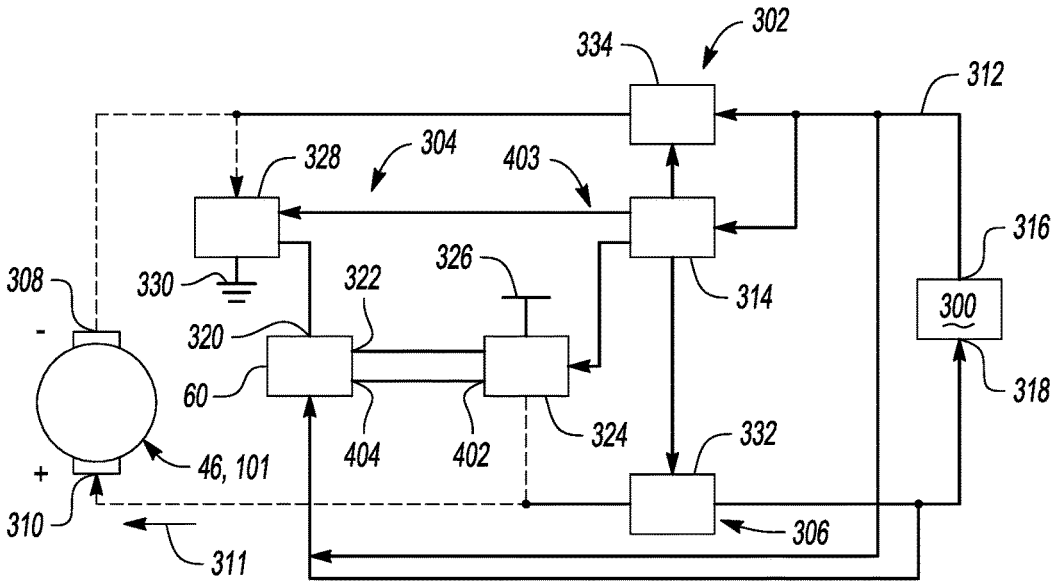

Fig-18

Electrical Characteristics: Diagnosis-40 mΩ

| Parameter | Symbol | Values | | | Unit | Note or Test Condition | Number |
|---|---|---|---|---|---|---|---|
| | | Min. | Typ. | Max. | | | |
| Current Sense Ratio at $I_L = I_{L11}$ | $k_{ILIS11}$ | -11% | 1800 | +11% | | $I_{L11}$=1A | P_9.7.6.15 |
| Current Sense Ratio at $I_L = I_{L13}$ | $k_{ILIS13}$ | -6% | 1800 | +6% | | $I_{L13}$=2A | P_9.7.6.17 |
| Current Sense Ratio at $I_L = I_{L15}$ | $k_{ILIS15}$ | -5% | 1800 | +5% | | $I_{L15}$=4A | P_9.7.6.19 |
| SENSE Current Derating with Low Current Calibration | $\Delta k_{ILIS(OL)}$ | -30 | 0 | +30 | % | 1) $I_{L(CAL)_OL} = I_{L04}$ $I_{L(CAL)_OL_H} = I_{L05}$ $I_{L(CAL)_OL_L} = I_{L02}$ $T_{A(CAL)}$ =25°C | P_9.7.6.27 |
| SENSE Current Derating with NominalCurrent Calibration | $\Delta k_{ILIS(NOM)}$ | -4 | 0 | +4 | % | 1) $I_{L(CAL)} = I_{L13}$ $I_{L(CAL)_H} = I_{L15}$ $I_{L(CAL)_L} = I_{L11}$ $T_{A(CAL)}$ =25°C | P_9.7.6.29 |

1) Not subject to production test - specified by design.

Fig-19

| Color | Description | No (r/min) | Io (A) | Is (A) | Ts (mNm) | Volts (V) | Kt (mNm/A) | Rt (ohms) | Nm (mNm/SW) |
|---|---|---|---|---|---|---|---|---|---|
| ——— | -40 DEG C | 18573 | 0.10 | 8.18 | 53.7 | 16.0 | 6.65 | 1.96 | 4.75 |

SYSTEM TO ISOLATE TWO MOTOR DRIVING CIRCUITS DRIVING A SINGLE MOTOR AND METHOD FOR ISOLATION

CROSS-REFERENCE TO RELATED APPLICATION

This utility application claims the benefit of U.S. Provisional Application No. 62/913,310 filed Oct. 10, 2019 and U.S. Provisional Application No. 62/966,390 filed Jan. 27, 2020. The entire disclosures of the above applications are incorporated herein by reference.

FIELD

The present disclosure is generally related to an isolation system for isolating two motor driving circuits. More particularly, the present disclosure is directed to an isolation system used in a closure latch assembly having a power-operated actuator with an electric motor operable in a powered state to shift an actuatable mechanism from a non-actuated state into an actuated state.

BACKGROUND

This section provides background information related to closure latches and is not necessarily prior art to the closure latch of the present disclosure.

In view of consumer demand for motor vehicles equipped with advanced comfort and convenience features, many modern vehicles are now provided with a passive keyless entry system to permit locking, unlocking and release of closure panels (i.e., passenger doors, tailgates, liftgates, decklids, etc.) without the use of a traditional key-type entry system. Some of the most popular features now available in association with closure systems include power locking/unlocking, power release and power cinching. These "powered" features are provided by a closure latch assembly mounted to the closure panel and equipped with a latch mechanism, a power-operated latch release mechanism and/or a power-operated latch cinch mechanism. Typically, the latch mechanism includes a ratchet and pawl arrangement configured to latch the closure panel in a closed position by virtue of the ratchet being held in a striker capture position to releasably engage and retain a striker that is mounted to a structural portion of the vehicle. The ratchet is held in its striker capture position by the pawl mechanically engaging the ratchet in a ratchet holding position. In many closure latch assemblies, the latch mechanism is configured such that the pawl is operable in its ratchet holding position to mechanically engage and retain the ratchet in at least two distinct striker capture positions, namely a secondary (i.e., "soft close") striker capture position and a primary (i.e., "hard close") striker capture position.

In closure latch assemblies providing a power release feature, a power release actuator is selectively actuated to cause the latch release mechanism to move the pawl from its ratchet holding position into a ratchet releasing position, whereby a ratchet biasing arrangement is permitted to forcibly pivot the ratchet from its striker capture position(s) into a striker release position for releasing the striker and allowing movement of the closure panel from its closed position to an open position. In closure latch assemblies providing a power cinching feature, a power cinch actuator is selectively actuated to cause the latch cinch mechanism to pivot the ratchet from its secondary striker capture position into its primary striker capture position, while the pawl is maintained in its ratchet holding position, thereby cinching the closure panel from a partially-closed position into a fully-closed position. A common electrically powered actuator, or separate electrically-powered actuators, can be associated with the power release and power cinching features. However, the power release feature is typically independent from the power cinching feature.

In many closure latch assemblies providing the power release feature, the latch release mechanism is normally maintained in a non-actuated state and is only shifted into an actuated state when sensors indicate a door release operation has been requested and authenticated by the passive keyless entry system (i.e., via actuation of a key fob or a handle-mounted switch). Actuation of the power release actuator is required for shifting the latch release mechanism from its non-actuated state into its actuated state. Following completion of the power release operation, when the sensors indicate that the ratchet is located in its striker release position, the latch release mechanism must be "reset", that is returned to its non-actuated state, to permit subsequent latching of the latch mechanism upon movement of the closure panel toward its closed position(s).

As noted, the electric motor can be driven in the first or "actuation" direction to actuate an actuatable mechanism (i.e., latch release, latch cinch, etc.) and is subsequently driven in the second or "reset" direction to reset the actuatable mechanism. In some applications, multiple modules on the vehicle may be used to control the electric motor. However, because the electric motor is sometimes driven in different directions, one motor driver associated with one module could attempt to drive the electric motor in one direction while another module is simultaneously attempting to drive the electric motor in the opposite direction, resulting in a short circuit. Thus, the modules controlling the electric motor may be required to do so at different times and/or communicate with one another, resulting in increased system complexity and cost.

In view of the above, a recognized need exists to address current shortcomings associated with power-operated closure latch assemblies and provide solutions that advance the art.

SUMMARY

This section provides a general summary of the disclosure and is not intended to be considered as a comprehensive and exhaustive listing of its full scope or all of its aspects, features and objectives.

In one aspect of the present disclosure there is provided an isolation system for an electric motor of an actuatable mechanism, the system includes a controller coupled to the electric motor and is configured to provide a primary driving signal to the electric motor. The system further includes an external motor controller configured to provide a secondary driving signal to the electric motor. The controller is configured to control supply of the primary driving signal to the electric motor based on the supply of the secondary driving signal to the electric motor.

In accordance with another aspect of the present disclosure an isolation system for an electric motor of an actuatable mechanism. The system includes a primary motor driving circuit and a secondary motor driving circuit each coupled to the electric motor. The secondary motor driving circuit is coupled to an external motor controller configured to provide a secondary driving signal to the secondary motor driving circuit. A primary controller is coupled to the primary motor driving circuit and configured to monitor the secondary driving signal and control the primary motor driving circuit. An isolation logic unit is coupled to the primary and secondary motor driving circuits and the primary controller and the external motor controller. The isolation logic unit is configured to isolate the primary motor driving circuit from the secondary motor driving circuit in response to the external motor controller providing the secondary driving signal to the secondary motor driving circuit.

It is yet another aspect of the present disclosure to provide a closure latch assembly for a closure panel of a motor vehicle. The closure latch assembly includes a latch mechanism operable in a first state to locate the closure panel in a first position and in a second state to locate the closure panel in a second position. The closure latch assembly also includes a power actuator that has an actuatable mechanism with an electric motor including a release motor shaft. The actuatable mechanism is operable in a non-actuated state to permit the latch mechanism to operate in its first state and in an actuated state to shift the latch mechanism from its first state into its second state. The electric motor being operable to drive the release motor shaft in one of an actuation direction for causing the actuatable mechanism to shift from its non-actuated state into its actuated state and a reset direction so as to reset the actuatable mechanism from its actuated state to its non-actuated state. A primary motor driving circuit and a secondary motor driving circuit are each coupled to the electric motor for independently driving the electric motor. A primary controller is coupled to the primary motor driving circuit and configured to monitor the secondary driving signal and control the primary motor driving circuit. An isolation logic unit is coupled to the primary and secondary motor driving circuits and the primary controller and the external motor controller. The isolation logic unit is configured to isolate the primary motor driving circuit from the secondary motor driving circuit in response to the external motor controller controlling the secondary motor driving circuit with the secondary driving signal.

It is another aspect of the present disclosure to provide a method of isolating a primary motor driving circuit and a secondary motor driving circuit. Each of the primary and secondary motor driving circuits independently driving an electric motor of an actuatable mechanism. The method includes the step of providing a secondary driving signal to the secondary motor driving circuit using an external motor controller coupled to the secondary motor driving circuit. The method continues with the step of receiving the secondary driving signal using an isolation logic unit coupled to the primary and secondary motor driving circuits and the external motor controller. The method proceeds with the step of isolating the primary motor driving circuit being controlled by a primary controller from the secondary motor driving circuit using the isolation logic unit in response to the external motor controller providing the secondary driving signal to the secondary motor driving circuit.

It is yet another aspect of the present disclosure to provide an isolation system for an electric motor of an actuatable mechanism. The system includes a primary motor driving circuit and a secondary motor driving circuit each coupled to the electric motor. The secondary motor driving circuit is coupled to an external motor controller configured to provide a secondary driving signal to the secondary motor driving circuit. An isolation circuit is coupled to the primary and secondary motor driving circuits and the external motor controller. The isolation circuit is configured to isolate the primary motor driving circuit from the secondary motor driving circuit in response to the external motor controller providing the secondary driving signal to the secondary motor driving circuit.

In another aspect of the disclosure, the isolation logic unit is configured to electrically decouple the primary and secondary motor driving circuits when the primary motor driving circuit is configured to drive the electric motor, and is further configured to electrically couple the primary and secondary motor driving circuits when the primary motor driving circuits is not configured to drive the electric motor.

In another aspect of the disclosure, the electric motor is driven by the secondary driving signal when the isolation logic unit is configured to electrically couple the primary and secondary motor driving circuits.

In another aspect of the disclosure, the isolation logic unit is configured to electrically couple the primary and secondary motor driving circuits subsequent to the secondary motor driving circuits being configured by the isolation circuit to not drive the electric motor.

In another aspect of the disclosure, the isolation logic unit configures the primary motor driving circuits to not drive the electric motor in response to the external motor controller providing the secondary driving signal.

In another aspect of the disclosure, the electric motor is one of a power release motor, a lock motor, a reset motor, and a cinch motor.

A further aspect of the present disclosure is to provide a method of driving an electric motor of an actuatable mechanism using one of a primary motor driving circuit and a secondary motor driving circuit. The method includes the step of configuring an isolation circuit to electrically decouple the electric motor and the secondary motor driving circuits. Next, configuring the primary motor driving circuit to drive the electric motor in response to configuring the isolation circuit to electrically decouple the electric motor and secondary motor driving circuit. The method continues with the step of receiving a secondary driving signal by the isolation circuit from an external motor controller coupled to the secondary motor driving circuit. The next step of the method is configuring the primary motor driving circuit to not drive the electric motor in response to receiving the secondary driving signal by the isolation circuit. The method also includes the step of configuring the isolation circuit to electrically couple the electric motor and the secondary motor driving circuit in response to configuring the primary motor driving circuit to not drive the electric motor. The method additionally includes the step of driving the electric motor using the secondary driving signal.

It is another aspect of the disclosure to provide another isolation system for a release electric motor of an actuatable mechanism. The system includes a primary motor driving circuit and a secondary motor driving circuit each coupled to the release electric motor. The secondary motor driving circuit is coupled to an external motor controller configured to provide a secondary driving signal to the secondary motor driving circuit. A primary controller is coupled to the primary motor driving circuit and configured to monitor the secondary driving signal and control the primary motor driving circuit. An isolation logic unit is coupled to the primary and secondary motor driving circuits and the primary controller and the external motor controller. The isolation logic unit is configured to isolate the primary motor driving circuit from the secondary motor driving circuit in response to the external motor controller providing the secondary driving signal to the secondary motor driving circuit. A timer circuit is coupled to the external motor controller and the primary motor driving circuit. The timer circuit is configured to receive the secondary driving signal from the external motor controller and enable the primary controller to control the primary motor driving circuit to drive the release electric motor for a predetermined amount of time independent of a duration of the secondary driving signal.

In another aspect of the disclosure, the timer circuit includes a comparator having a noninverting input coupled to a power supply and an inverting input and a comparator output. The timer circuit also includes a timer resistor connected between the first release output and a timer capacitor connected between the inverting input and an electrical ground and configured to be charged by the secondary driving signal through the timer resistor. The comparator is additionally configured to compare a capacitor voltage at the noninverting input to a power supply voltage at the inverting input and output a digital one at the comparator output in response to the capacitor voltage being greater than the power supply voltage and output a digital zero at the comparator output in response to the capacitor voltage being less than the power supply voltage. The timer circuit also includes a timer switch connected to the comparator output to provide a timer output signal delayed by the predetermined amount of time.

In another aspect of the disclosure, the timer switch is a bipolar junction transistor having a timer emitter connected to a logic high voltage and a timer collector and a timer base connected to the comparator output to provide the timer output signal at the timer collector.

In another aspect of the disclosure, the isolation logic unit further includes a terminal control switch coupled to the electrical ground and a second release motor terminal of the release electric motor and controlled by the timer output signal at the timer collector for grounding the second release motor terminal in response to the timer output signal being a logic high voltage. The isolation logic unit also includes a third primary disable switch coupled to the electrical ground and a second primary high side enable input of a primary high side switch of the primary motor driving circuit and controlled by the first release output of the external motor controller for grounding the second primary high side enable input of the primary high side switch to disable the primary high side switch in response to the external motor controller providing the secondary driving signal to the secondary motor driving circuit. The isolation logic unit additionally includes a fourth primary disable switch coupled to the electrical ground and the terminal control switch and controlled by the first release output of the external motor controller for turning the terminal control switch off in response to the external motor controller providing the secondary driving signal to the secondary motor driving circuit. In addition, the isolation logic unit includes a fifth primary disable switch coupled to the electrical ground and a primary low side switch of the of the primary motor driving circuit and controlled by the first release output of the external motor controller for turning the primary low side switch off in response to the external motor controller providing the secondary driving signal to the secondary motor driving circuit. The isolation logic unit also includes a supplementary secondary high side switch coupled between a secondary high side switch of the secondary motor driving circuit and a second release output of the external motor controller and controlled by one of the second release output and the isolation logic unit. The isolation logic unit additionally includes a supplementary secondary low side switch coupled between a secondary low side switch of the secondary motor driving circuit and the first release output of the external motor controller and controlled by one of the first release output and the isolation logic unit.

In another aspect of the disclosure, the terminal control switch is a field effect transistor including a terminal control source coupled to the electrical ground and a terminal control drain coupled to the second release motor terminal of the release electric motor and a terminal control gate coupled to the timer collector. The third primary disable switch is a bipolar junction transistor including a third primary disable emitter coupled to the electrical ground and a third primary disable collector coupled to the second primary high side enable input of the primary high side switch of the primary motor driving circuit and a third primary disable base coupled to the first release output of the external motor controller. The fourth primary disable switch is a bipolar junction transistor including a fourth primary disable emitter coupled to the electrical ground and a fourth primary disable collector coupled to the terminal control gate of the terminal control switch and a fourth primary disable base coupled to the first release output of the external motor controller. The fifth primary disable switch is a bipolar junction transistor including a fifth primary disable emitter coupled to the electrical ground and a fifth primary disable collector coupled to a primary low gate of the primary low side switch and a fifth primary disable base coupled to the first release output of the external motor controller. The supplementary secondary high side switch is a field effect transistor including a supplementary secondary high source coupled to a secondary high source of the secondary high side switch and a supplementary secondary high drain coupled to second release output of the external motor controller and a supplementary secondary high gate coupled to the isolation logic unit. The supplementary secondary low side switch is a field effect transistor including a supplementary secondary low source coupled to a secondary low source of the secondary low side switch and a supplementary secondary low drain coupled to first release output of the external motor controller and a supplementary secondary low gate coupled to the isolation logic unit.

In another aspect of the disclosure, the isolation system further includes an open indication switch detecting a position of a ratchet of the actuatable mechanism being closed when the ratchet is in an open position and open when the ratchet is in a closed position, the open indication switch coupled to the electrical ground and to the timer capacitor of the timer circuit to discharge the timer capacitor to cause the operation of the release electric motor during the predetermined amount of time to cease.

In another aspect of the disclosure, the primary controller is configured to operate the primary motor driving circuit for the predetermined amount of time. The primary controller is also configured to determine whether the release electric motor has transitioned a corresponding actuatable mechanism to release before the expiration of the predetermined amount of time. The primary controller is additionally configured to return to the step of operating the primary motor driving circuit in response to determining that the actuatable mechanism is not released before the expiration of the predetermined amount of time. In addition, the primary controller is configured to stop control of the release electric motor by the primary motor driving circuit in response to determining that the actuatable mechanism is released before the expiration of the predetermined amount of time.

It is an additional aspect of the disclosure to provide another method of operating the actuatable mechanism. The method includes the step of receiving a trigger command signal from an external motor controller. The method continues with the step of transitioning to a local latch control mode to operate the actuatable mechanism independently of further command from the external motor controller in response to receiving the trigger command signal.

In another aspect of the disclosure, the step of receiving a trigger command signal from an external motor controller includes receiving the secondary driving signal from the external motor controller. The method further includes the step of operating a primary motor driving circuit coupled to a release electric motor of the actuatable mechanism for a predetermined amount of time independent of a duration of the secondary driving signal. The method also includes the step of determining whether the actuatable mechanism is released before the expiration of the predetermined amount of time. In addition, the method includes the step of returning to the step of operating the primary motor driving circuit coupled to the release electric motor of the actuatable mechanism in response to determining that the actuatable mechanism is not released before the expiration of the predetermined amount of time. The method additionally includes the step of stopping control of the release electric motor by the primary motor driving circuit in response to determining that the actuatable mechanism is released before the expiration of the predetermined amount of time.

In another aspect of the disclosure, the method further includes the step of enabling a primary controller to control the primary motor driving circuit to drive the release electric motor for the predetermined amount of time independent of the duration of the secondary driving signal using a timer circuit coupled to the external motor controller and the primary motor driving circuit and configured to receive the secondary driving signal.

In another aspect of the disclosure, the method further includes the step of charging a timer capacitor of the timer circuit with the secondary driving signal through a timer resistor of the timer circuit connected to a first release output of the external motor controller. The method also includes the step of comparing a capacitor voltage of the timer capacitor at a noninverting input of a comparator to a power supply voltage of a power supply at an inverting input of the comparator. The method continues with the step of outputting a digital one at the comparator output in response to the capacitor voltage being greater than the power supply voltage. Next, outputting a digital zero at the comparator output in response to the capacitor voltage being less than the power supply voltage. The method additionally includes the step of providing a timer output signal delayed by the predetermined amount of time using a timer switch connected to the comparator output.

In yet another further aspect of the present disclosure there is provided a method for isolating an electric motor of an actuatable mechanism, the method includes the steps of supplying a primary driving signal to the electric motor using a controller coupled to the electric motor, supplying a secondary driving signal to the electric motor using an external motor controller to, and controlling supply of the primary driving signal to the electric motor based on the supply of the secondary driving signal to the electric motor.

In yet another aspect of the present disclosure there is provided a latch assembly for a closure panel of a motor vehicle, the latch assembly housing an electric motor of an actuatable mechanism and a controller coupled to the electric motor and to a main vehicle power supply, where the controller is configured to select between a primary driving signal generated locally to the latch assembly for supply to the electric motor and a secondary driving signal generated remotely by an external controller for supply to the electric motor. In a related aspect, the controller is configured to select between a primary driving signal and a secondary driving signal such that only one of the primary driving signal and the secondary driving signal is supplied to the electric motor. In a related aspect, the primary driving signal is generated locally to the latch assembly using the vehicle main power supply. In another related aspect, the secondary driving signal is generated remotely by an external controller using the main vehicle power supply. In another aspect, the controller is configured to interrupt the supply of the primary driving signal to the electric motor when the secondary driving signal is detected, and supply the secondary driving signal to the electric motor. In another related aspect, the controller is configured to select between a primary driving signal generated locally to the latch assembly for supply to the electric motor and a secondary driving signal generated remotely by an external controller for supply to the electric motor when the main vehicle power is available.

In yet another aspect of the present disclosure there is provided a latch assembly for a closure panel of a motor vehicle, the latch assembly housing an electric motor of an actuatable mechanism and a controller coupled to the electric motor and to a main vehicle power supply and to an external controller, such as a Body Control Module, where the controller is configured to supply the primary driving signal to the electric motor independently from the secondary driving signal being supplied from the external controller to the latch assembly.

Further areas of applicability will become apparent from the description provided herein. The description and specific embodiments listed in this summary are for purposes of illustration only and are not intended to limit the scope of the present disclosure.

DRAWINGS

The drawings described herein have been provided to illustrate selected embodiments and specific features thereof and are not intended to limit the scope of the present disclosure. The present disclosure will now be described by way of example only with reference to the attached drawings, in which:

FIGS. 10-18 illustrate the isolation system in operation according to aspects of the disclosure;

FIG. 19 illustrates a table showing example sense ratios for a high side switch of the isolation system according to aspects of the disclosure;

DETAILED DESCRIPTION

Example embodiments of closure latch assemblies and a corresponding isolation system for use in motor vehicle door closure systems are provided so that this disclosure will be thorough, and will fully convey the scope to those who are skilled in the art. The present disclosure is specifically directed to implementing the isolation system in the closure latch assembly in association with a power-operated actuatable mechanism. While the isolation system is disclosed to be used in a latch release mechanism, the teachings of the present disclosure relating to isolation system are applicable to use with other power actuators. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 1:
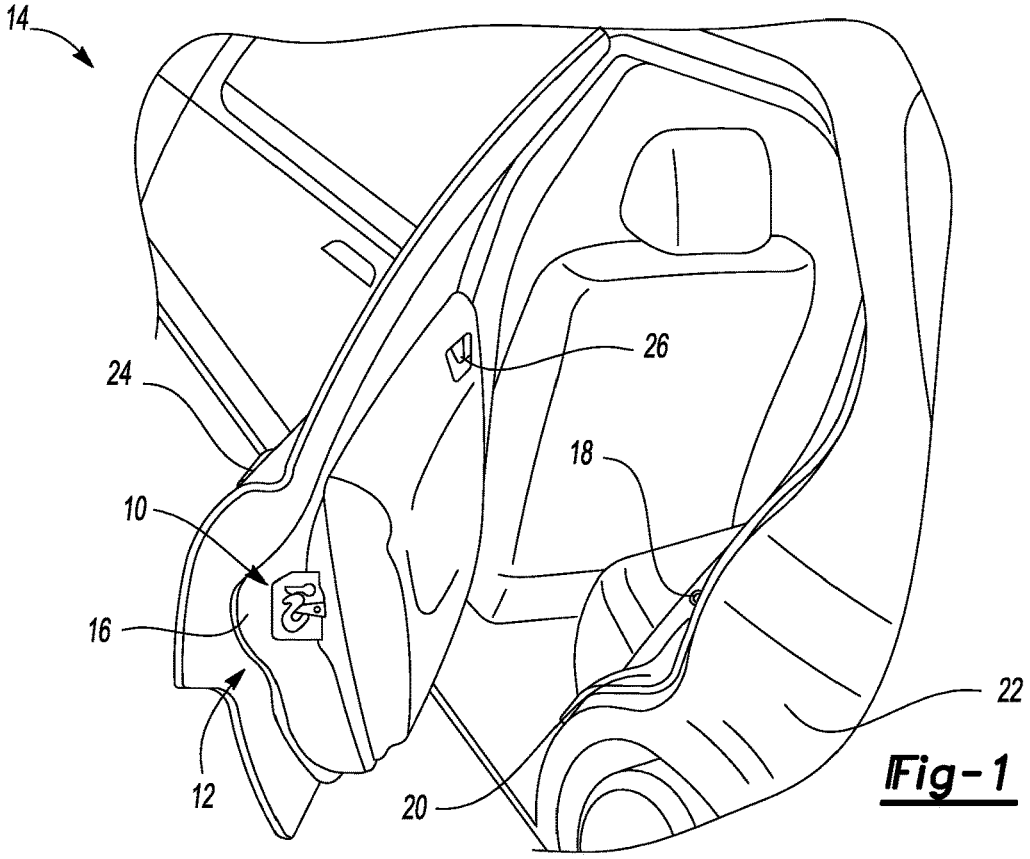
FIG. 1 is an isometric view of a motor vehicle with a passenger door that is equipped with a closure latch assembly according to aspects of the disclosure.

Referring initially to FIG. 1, a closure latch assembly 10 for a passenger door 12 of a motor vehicle 14 is shown positioned along a rear edge portion 16 of door 12 and is configured to releasably engage a striker 18 secured in a door opening 20 formed in the vehicle's body 22 in response to movement of door 12 from an open position (shown) to a closed position. Door 12 includes an outside door handle 24 and an inside door handle 26, both of which are operatively coupled (i.e., electrically and/or mechanically) to closure latch 10.

Figure 2:
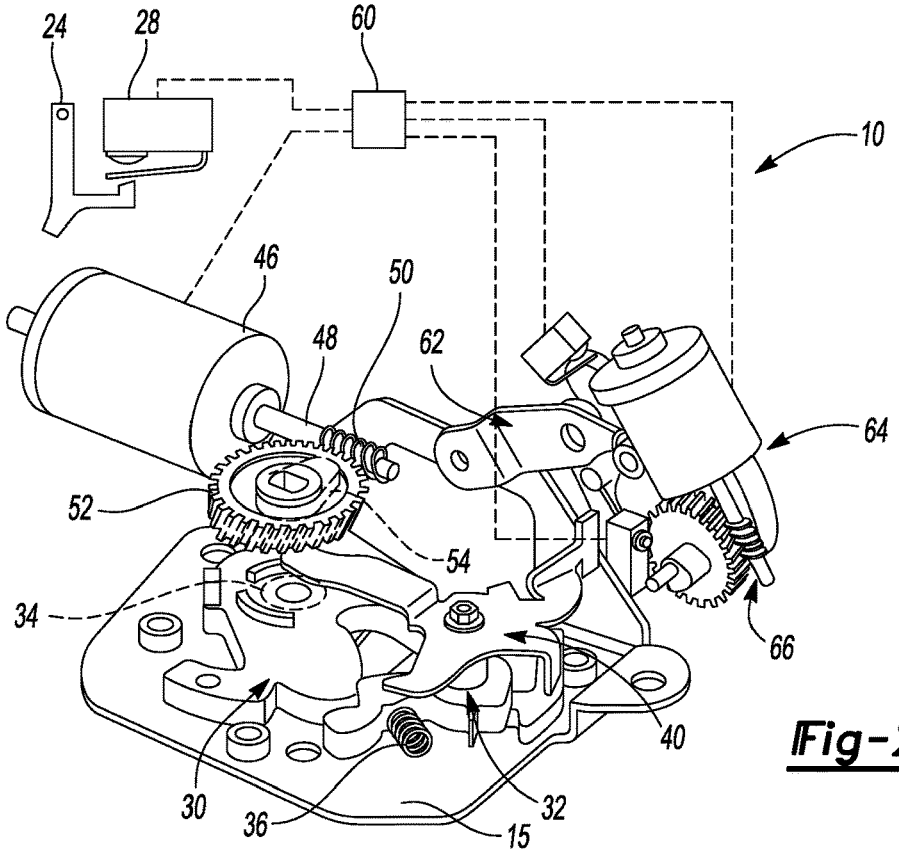
FIG. 2 is an isometric view of a closure latch assembly equipped with a latch mechanism and a power-operated latch release mechanism according to aspects of the disclosure.

Referring now to FIG. 2, a non-limiting embodiment of closure latch assembly 10 is shown to generally include a latch mechanism, a latch release mechanism, a power release actuator, and a power lock actuator. The latch mechanism includes a ratchet 30 and a pawl 32. Ratchet 30 is mounted to a latch plate 15 and moveable between a first or "striker capture" position whereat the ratchet 30 retains striker 18 and a second or "striker release" position whereat ratchet 30 permits release of striker 18. A ratchet biasing member, such as a torsion spring 34, biases ratchet 30 toward its striker release position. Pawl 32 is also mounted to latch housing 15 and is pivotably moveable relative to ratchet 30 between a first or "ratchet holding" position whereat pawl 32 holds ratchet 30 in its striker capture position and a second or "ratchet releasing" position whereat pawl 32 permits ratchet 30 to move to its striker release position. A pawl biasing member, such as a coil spring 36, biases pawl 32 toward its ratchet holding position. With pawl 32 located in its ratchet holding position for mechanically holding ratchet 30 in its striker capture position, the latch mechanism is considered to be operating in a latched state. In contrast the latch mechanism is considered to be operating in an unlatched state when pawl 32 is located in its ratchet releasing position and ratchet 30 is located in its striker release position. Closure latch assembly 10 may be configured as a "smart latch", or "E-latch" for example having integrated a controller which may or may not be configured having back up as illustratively described in U.S. Pat. Nos. 10,655,368, 10,428,560, 10,329,807, 10,378,251 and US Patent Application Nos. US20190309564A1, as examples, and all of which are incorporated herein by reference in their entireties.

The latch release mechanism includes, among other things, a pawl release lever 40 operatively connected to pawl 32 and which is movable between a first or "pawl release" position whereat pawl release lever 40 causes pawl 32 to move from its ratchet holding position to its ratchet releasing position and a second or "home" position whereat pawl release lever 40 permits pawl 32 to be maintained in its ratchet holding position. A pawl release lever biasing member, such as a suitable pawl release lever spring 42, is provided to bias pawl release lever 40 to its home position. Pawl release lever 40 may be moved from its home position to its pawl release position by several components such as, for example, inside and/or outside handle-actuated release mechanisms in addition to the power release actuator. With pawl release lever 40 located in its home position, the latch release mechanism is defined to be operating in a non-actuated state. In contrast, the latch release mechanism is defined to be operating in an actuated state when pawl release lever 40 is located in its pawl release position.

The power release actuator includes, among other things, the power release electric motor 46 having a rotatable motor shaft 48, a power release worm gear 50 secured for rotation with motor shaft 48, a power release gear 52, and a power release cam 54. Power release worm gear 50, power release gear 52, and a power release cam 54 are examples of components forming a release chain between the motor 46 and the actuatable mechanism, and may further include other levers and gears and interconnections for coupling the rotation of the shaft 48 into a movement of the actuatable mechanism. Components of the kinematic chain have be pivotally mounted about a pivot, such as a shaft, so that reset mechanism may act to move, such as rotate, one of the components of the kinematic chain, for example by acting on the shaft supporting the components of the kinematic chain for rotation, in a manner as will be described in more details herein below. Power release cam 54 is connected for common rotation with power release gear 52 and is rotatable between a first or "pawl release" range of positions and a second or "pawl non-release" range of positions. Power release gear 52 is driven by worm gear 50 in response to actuation of power release electric motor 46 and, in turn, drives power release cam 54 which controls the pivoting movement of pawl release lever 40 between its home and pawl release positions. The tooth mesh characteristics of power release gear 52 and worm gear 50 establish a reduction ratio torque multiplication between motor shaft 48 and power release cam 54.

The power release actuator may be used as part of a passive entry system to provide the power release feature. When a person approaches vehicle 14 with an electronic key fob and actuates outside door handle 24, an electronic latch release system associated with vehicle 14 senses both the presence of the key fob and that outside door handle 24 has been actuated (e.g., via communication between a switch 28 and an electronic control unit (ECU) shown at 60 that at least partially controls the operation of closure latch assembly 10). In turn, ECU 60 actuates the power release actuator to actuate the latch release mechanism for releasing the latch mechanism and unlatch closure latch assembly 10 so as to open the vehicle door. ECU, or controller 60, may be provided as a microprocessor mounted on a printed circuit board provided within the latch assembly 10 housing, such as a microprocessor mounted on printed circuit board having reference numeral 7 and housed within body 9 of U.S. Pat. No. 10,329,807 as an example. Controller 60 may also be configured as a latch controller for controlling operations of the latch assembly 10.

The power lock actuator controls the operative connection between an inside release lever 62 associated with the inside door release mechanism and pawl release lever 40. The power lock actuator includes, among other things, a power lock electric motor 64 and a lock a 66.

Figure 3:
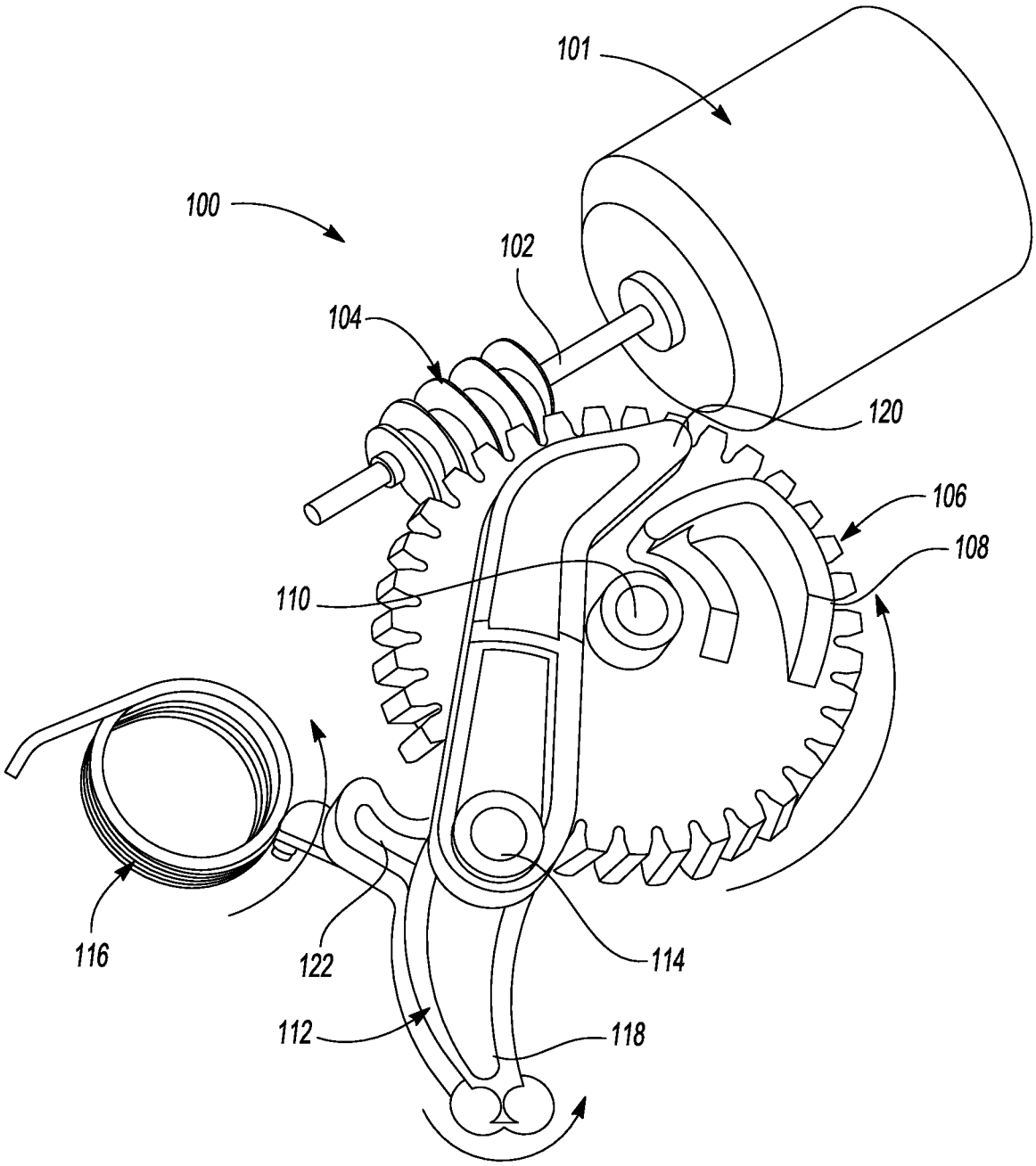
FIG. 3 is an isometric view showing various components of the power-operated latch release mechanism associated with the closure latch assembly shown in FIG. 2 according to aspects of the disclosure.

Referring now to FIG. 3, the components associated with a non-limiting embodiment of a power release actuator 100 adapted for use with closure latch assembly 10 are shown to include a power release electric motor 101 with a motor shaft 102 driving a worm gear 104, and a power release gear 106 having a release cam 108 formed thereon. Power release gear 106 is rotatable about a post 110 in a first or "releasing" (i.e., counterclockwise) direction and a second or "resetting" (i.e., clockwise) direction via actuation of power release motor 101. Power release gear 106 is rotatable about post 110 between a "home" position (shown) and a "released" position for causing pivotal movement of an actuator release lever 112 from a first or "non-actuated" position (shown) into a second or "actuated" position. Actuator release lever 112 is supported for pivotal movement relative to a pivot post 114 and is normally biased toward its non-actuated position by an actuator lever spring 116. Actuator lever 112 is operable in its non-actuated position to disengage its first leg segment 118 from pawl release lever 40, when located in its home position, so as to permit pawl 32 to remain in its ratchet holding position. In contrast, movement of actuator lever 112 from its non-actuated position to its actuated position causes its first leg segment 118 to engage and pivot pawl release lever 40 from its home position to its pawl release position, thereby causing pawl 32 to move from its ratchet holding position to its ratchet releasing position. A second leg segment 120 of actuator release lever 112 is engageable with release cam 108 due to the biasing of actuator lever spring 116. As such, rotation of power release gear 106 in its releasing direction from its home position to its released position causes corresponding pivotal movement of actuator release lever 112 from its non-actuated position into its actuated position. Likewise, rotation of power release gear 106 in its resetting direction from its released position to its home position results in corresponding pivotal movement of actuator release lever 112 from its actuated position to its non-actuated position.

Figure 4:
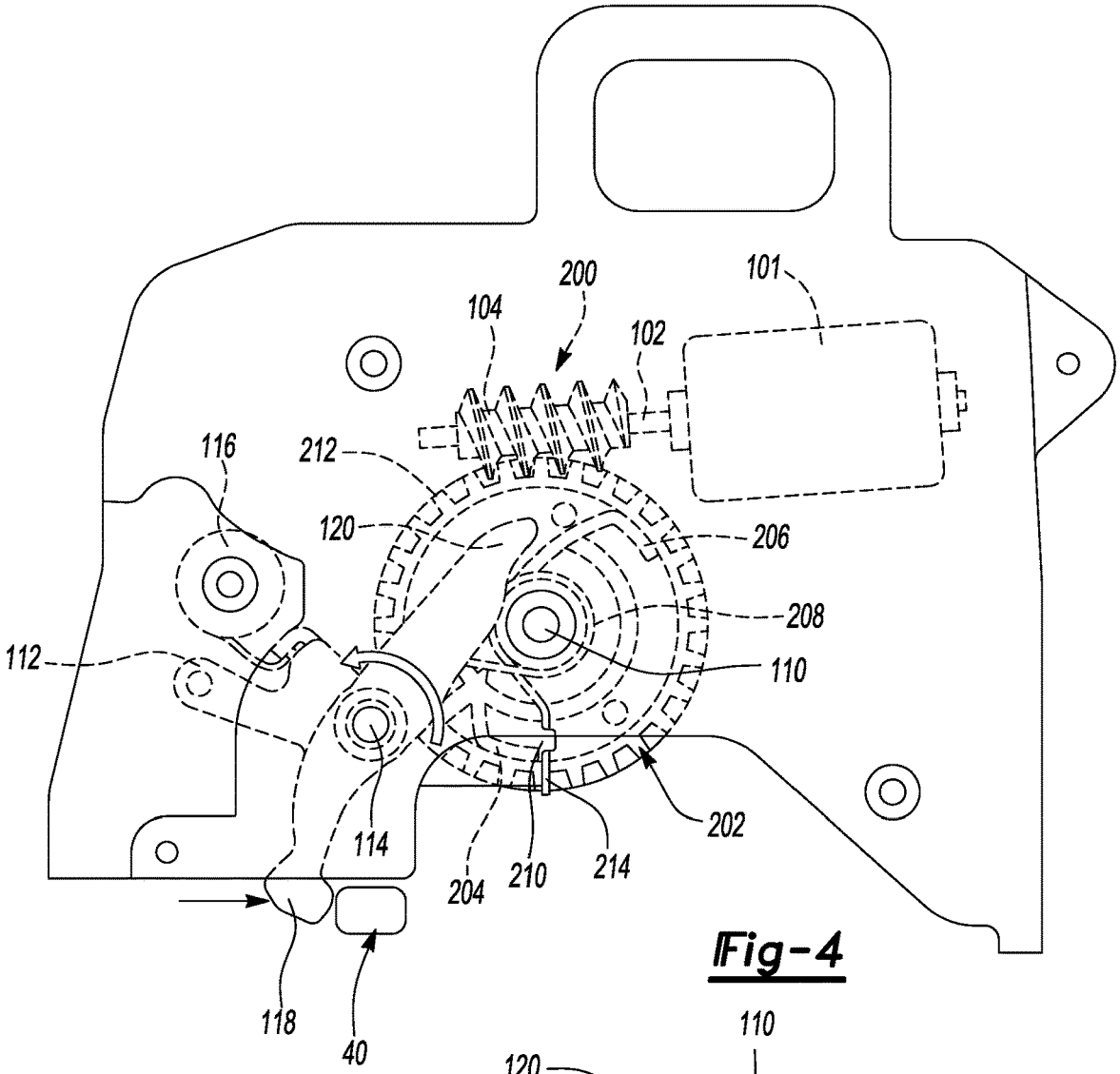
FIG. 4 is a plan view of the components associated with an alternative configuration of a bidirectional power-operated latch release mechanism associated with the closure latch assembly according to aspects of the disclosure.
Figure 5:
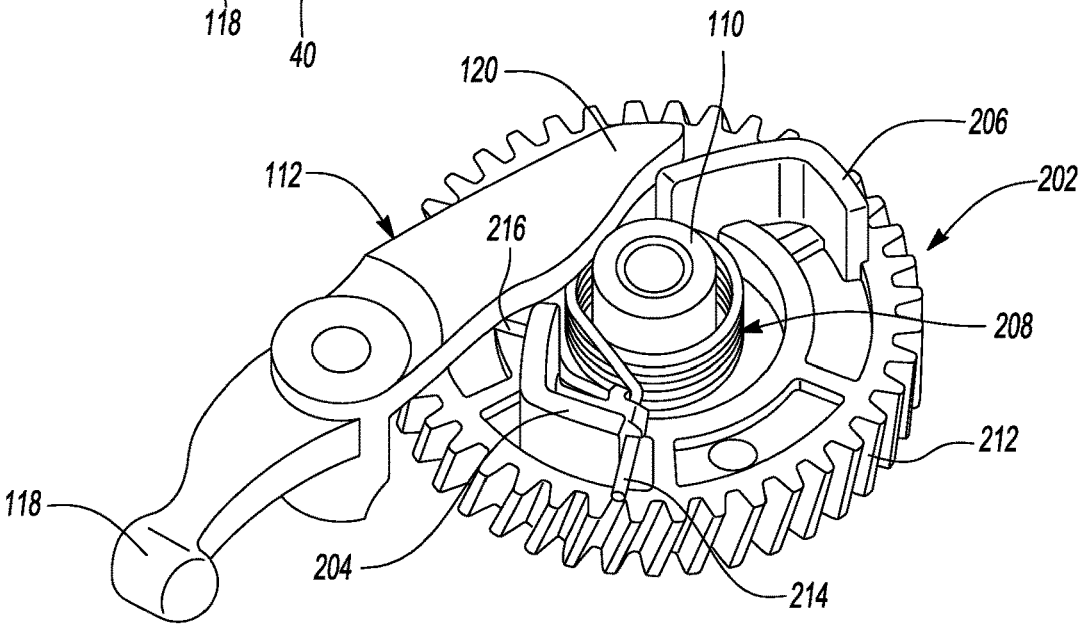
FIG. 5 is an isometric view of various components associated with the power-operated latch release mechanism shown in FIG. 4 according to aspects of the disclosure.

Referring now to FIG. 4, a power release actuator 200 is shown which is generally a modified version of power release actuator 100 (FIG. 3) and includes many similar components identified hereinafter and in the drawings using common reference numerals. Power release actuator 200 is configured to provide a bi-directional releasing function, with each directional releasing operation associated with a distinct operating mode for closure latch assembly 10. As seen, power release actuator 200 includes power release electric motor 101 with its motor shaft 102 driving worm gear 104, a power release gear 202 having a power release cam 204 and an emergency release cam 206, and a return spring 208 acting between power release gear 202 and a latch housing 210. Power release gear 202 has gear teeth 212 meshed with worm gear 104 such that rotation of motor output shaft 102 in a first direction causes corresponding rotation of power release gear 202 in a first (i.e., clockwise) direction and rotation of motor output shaft 102 in a second direction causes corresponding rotation of power release gear 202 in a second (i.e., counterclockwise) direction.

Power release gear 202 is shown in FIGS. 4, 5, 6A and 7A located in a neutral/home position with actuator release lever 112 located in its non-actuated position such that pawl release lever 40 is located in its home position with pawl 32 located in its ratchet holding position, thereby maintaining ratchet 30 in its striker capture position for establishing the Latched mode of closure latch assembly 10. In its neutral/home position, power release gear 202 is positioned such that neither of power release cam 204 and emergency release cam 206 are acting on actuation leg segment 120 of actuator release lever 112.

Figure 6B:
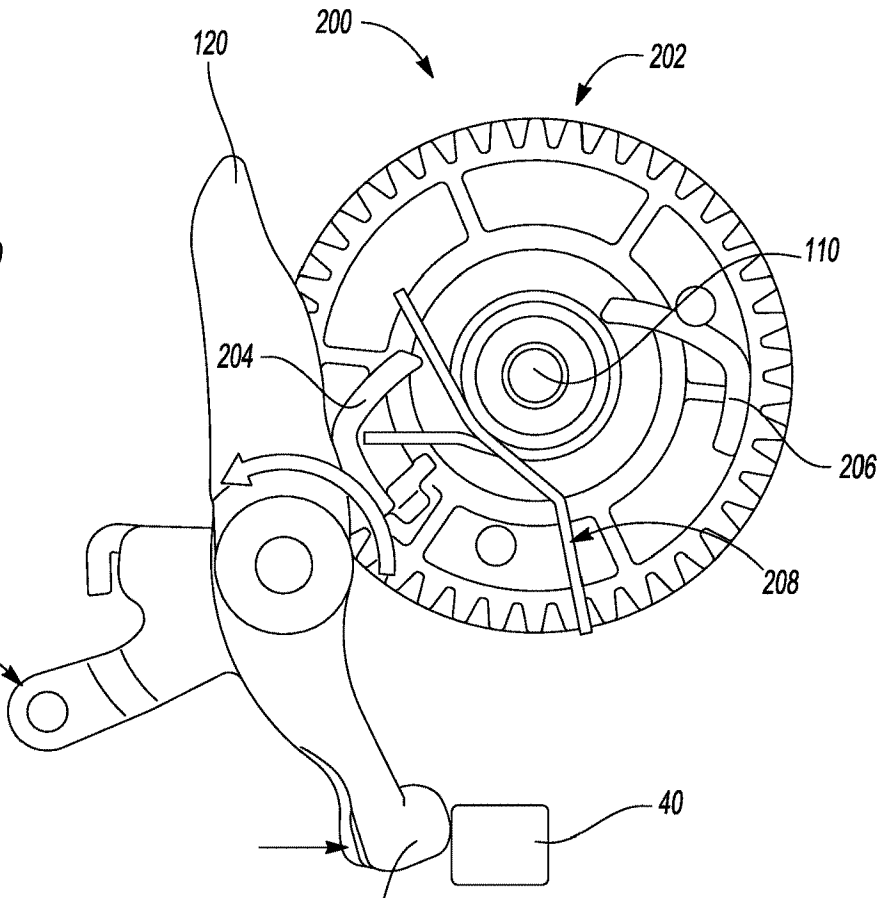
FIG. 6B illustrates the power release gear rotated in a first direction from its neutral/home position to a first released position when the closure latch is operating in a normal mode according to aspects of the disclosure.
Figure 6A:
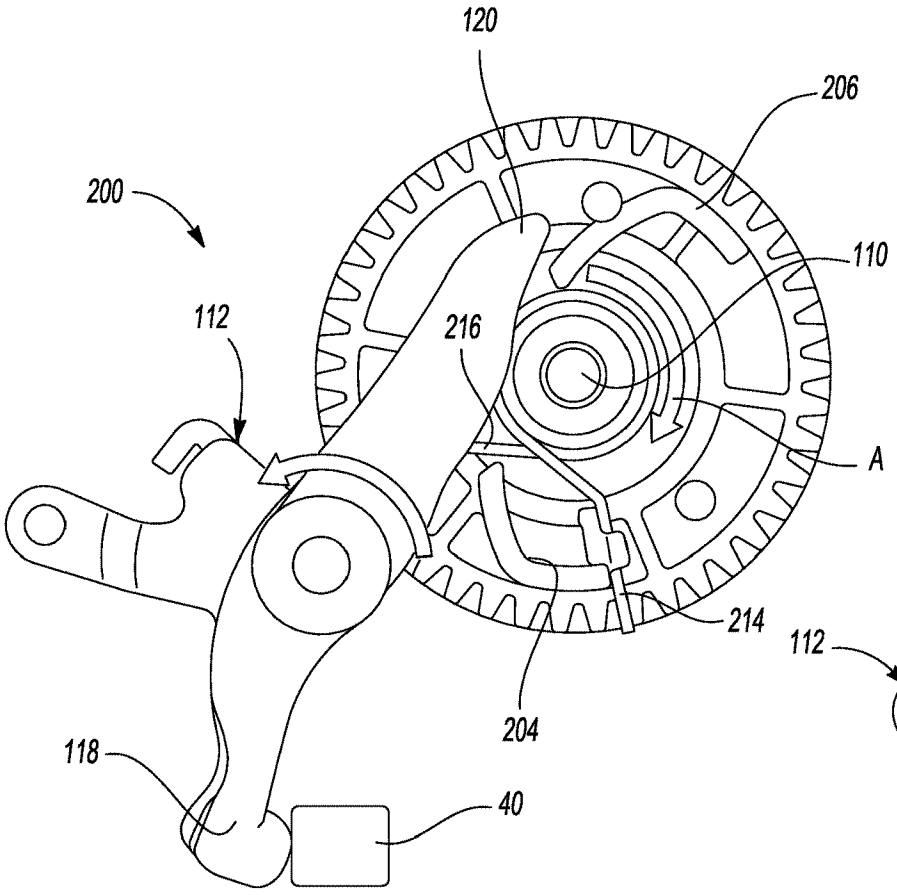
FIG. 6A illustrates a power release gear associated with the power-operated latch release mechanism shown in FIGS. 4 and 5 located in a neutral/home position.

When control unit 60 indicates that closure latch assembly 10 is supplied with electrical power from the vehicle's primary power source (i.e., the battery), power release actuator 200 is considered to be operating in a "normal release" mode. As such, when a power release signal is provided to closure latch assembly 10, power release electric motor 101 is energized to rotate power release gear 202 in a first releasing direction (i.e., clockwise), as indicated by arrow "A", from its neutral/home position (FIG. 6A) to a first released position (FIG. 6B). Such rotation of power release gear 202 causes power release cam 204 to engage actuator leg segment 120 of actuator release lever 112 and forcibly pivot actuator release lever 112, in opposition to the biasing of spring 116, from its non-actuated position to its actuated position for causing pawl 32 to move to its ratchet releasing position, thereby releasing ratchet 30 for movement to its striker release position. However, such rotation of power release gear 202 causes return spring 208 to be compressed (i.e., loaded) since its first end segment 214 is secured to power release gear 202 and its second end segment 216 engages a stationary portion of latch housing 210. Upon completion of the power release of the latch mechanism, a non-powered resetting function is completed. Specifically, power release motor 101 is turned off and return spring 208 backdrives power release gear 202 from its first released position (FIG. 6B) back to its neutral/home position (FIG. 6A) which, in turn, backdrives motor shaft 102 and release electric motor 101. Since power release gear 202 is mechanically reset during operation of closure latch assembly 10 in its normal operating mode, no noise is generated as is typically associated with powered resetting of the power release actuator.

Figure 7B:
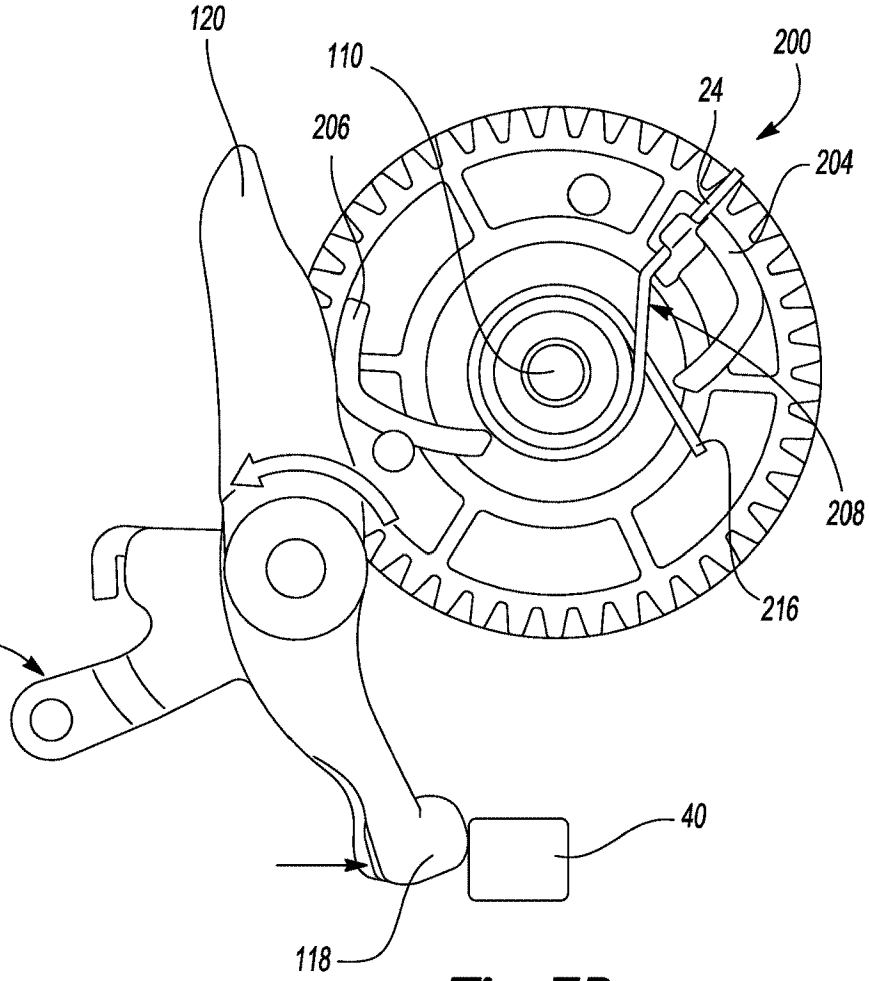
FIG. 7A illustrates the power release gear located in its neutral/home position and FIG. 7B illustrates rotation of the power release gear in a second or "emergency" release direction from its neutral/home position to a second released position when the closure latch assembly is operating in an emergency mode according to aspects of the disclosure.
Figure 7A:
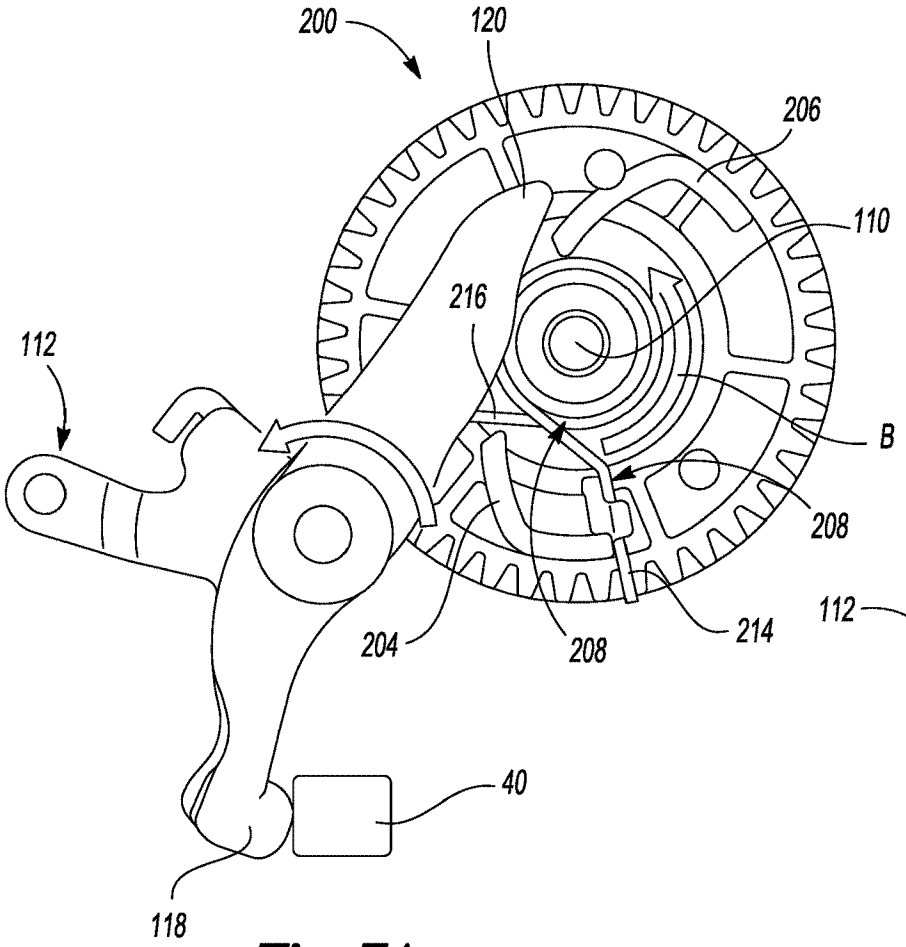

When control unit 60 indicates that closure latch assembly 10 is not supplied with electrical power from the vehicle's primary power source and may be relying on a backup power source (i.e., supercapacitors), power release mechanism 200 is considered to be operating in an "emergency release" mode. As such, when a signal is provided to release closure latch assembly 10, power release motor 101 is energized to rotate power release gear 202 in a second releasing direction (i.e., counterclockwise), as indicated by arrow "B", from its neutral/home position (FIG. 7A) to a second released position (FIG. 7B). Such rotation of power release gear 202 causes emergency release cam 206 to engage actuation leg segment 120 and forcibly pivot actuator release lever 112, in opposition to the biasing of spring 116, from its non-actuated position into its actuated position for causing pawl 32 to move to its ratchet releasing position, thereby releasing ratchet 30 for movement to its striker release position. However, such rotation of power release gear 202 in the second releasing direction does not act to cause return spring 208 to be loaded since its second end segment 216 is no longer engaged with a stationary component of latch housing 210. Thus, power release gear 202 is held in its second released position. Subsequent resetting of power release actuator 200, required for moving power release gear 202 from its second released position back to its neutral/home position, is completed either manually (if no power) or electrically (via backup power) by driving power release motor 101 in the opposite direction.

As discussed, some motor applications require the release electric motor 46, 101 to be powered in one direction to perform work—for example latch power release or cinch. At the end of such an operation, the release electric motor 46, 101 is rotated out of its rest or neutral/home position and not ready to perform the next cycle, therefore it needs to be returned to the neutral/home position. While return spring 208 can sometimes move the motor shaft 102 or the return spring 208, in other instances, the release electric motor 101 is driven in a second or reset direction (i.e., powered reset). So, for example, the release electric motor 46, 101 is driven in the first or "actuation" direction to actuate an actuatable mechanism (i.e., latch release, latch cinch, etc.) and is subsequently driven in the second or "reset" direction to reset the actuatable mechanism. The latch assembly 10 may therefore not be provided with a return spring 208.

Figure 8:
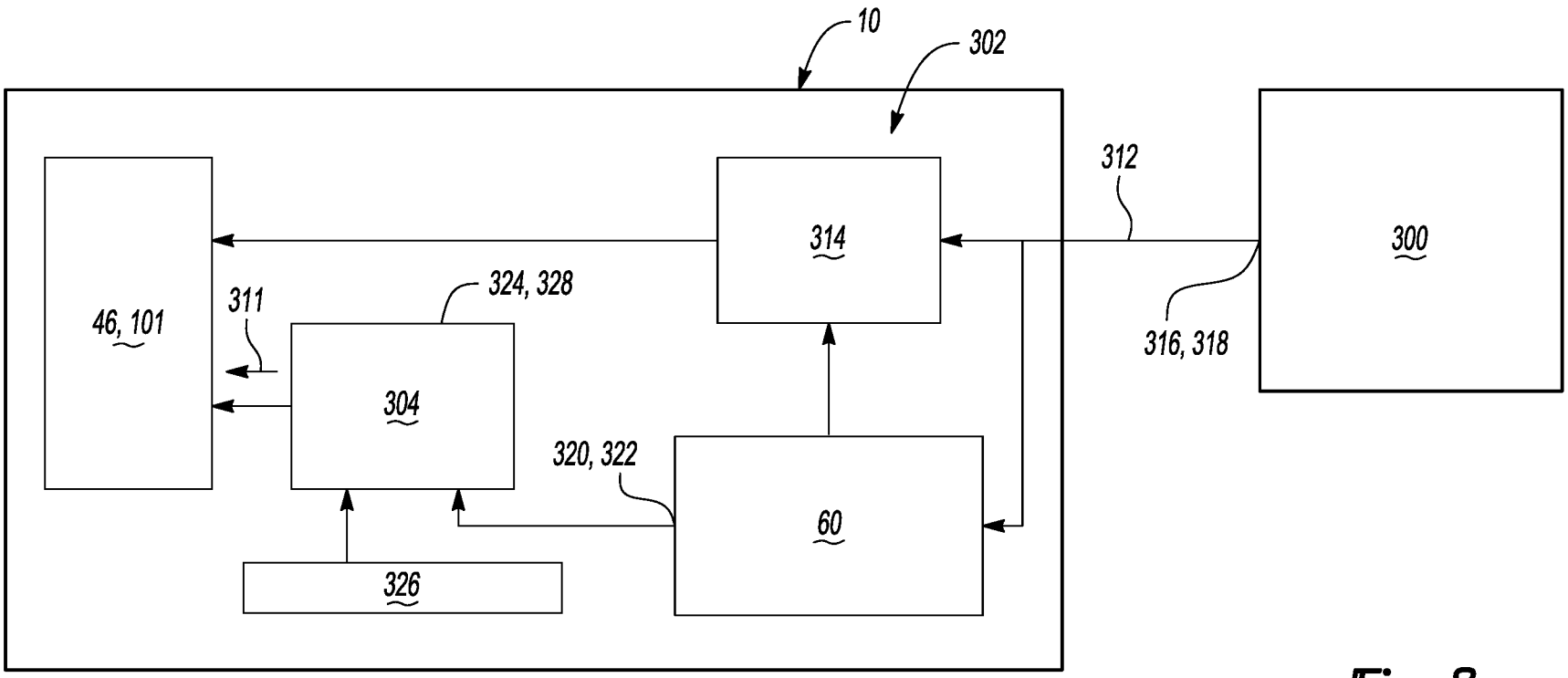
FIG. 8 is a block diagram of an isolation system of a closure latch assembly according to aspects of the disclosure.

Referring now to FIG. 8, and as described above, the release electric motor 46, 101 is part of the closure latch assembly 10. The release electric motor 46, 101 is also shown coupled to an external motor controller 300 (e.g., a body control module or BCM) that commands power release using release electric motor 46, 101 separately from the operation of a primary controller (e.g., electronic control unit 60). However, because the release electric motor 46, 101 is sometimes driven in different directions (e.g., actuation and reset directions), the primary controller 60 could attempt to drive the release electric motor 46, 101 in one direction while the BCM 300 is simultaneously attempting to drive the release electric motor 46, 101 in the opposite direction, potentially resulting in a short circuit. Thus, an isolation system 302 for the release electric motor 46, 101 is provided. A Body Control Module is one illustrative example of an external motor controller 300 which is remotely located from the closure latch assembly 10, and in other words the Body Control Module 300 and the closure latch assembly 10 may be mounted at different locations using different attachment points within the vehicle 14 and are each housed within separate and distinct housings. For example the BCM may be located on the vehicle body, while the closure latch assembly 10 is mounted on the closure panel or door. The Body Control Module and the closure latch assembly 10 maybe be in remote communication with each other over a communications network, such as a CAN or LIN network, or other types or wired or wireless connection, as examples. The Body Control Module is a type of controller that controls various subsystems of the vehicle 100 which may include for example control of an immobilizer system, power mirrors, etc., control power seats, and for example may be in electrical communication with a wireless access device, such as a key FOB using a wireless communication system and/or in electrical communication with various switches or other interface devices located on the vehicle 14 for generated signals recognizable by the BCM to indicate to the BCM to actuate power locks, such as for changing the lock/unlock state of the latch assembly 10, for actuating power release motors for changing the power release state of the latch assembly 10, for changing the double lock state of the latch, as non-limiting examples.

Figure 9:
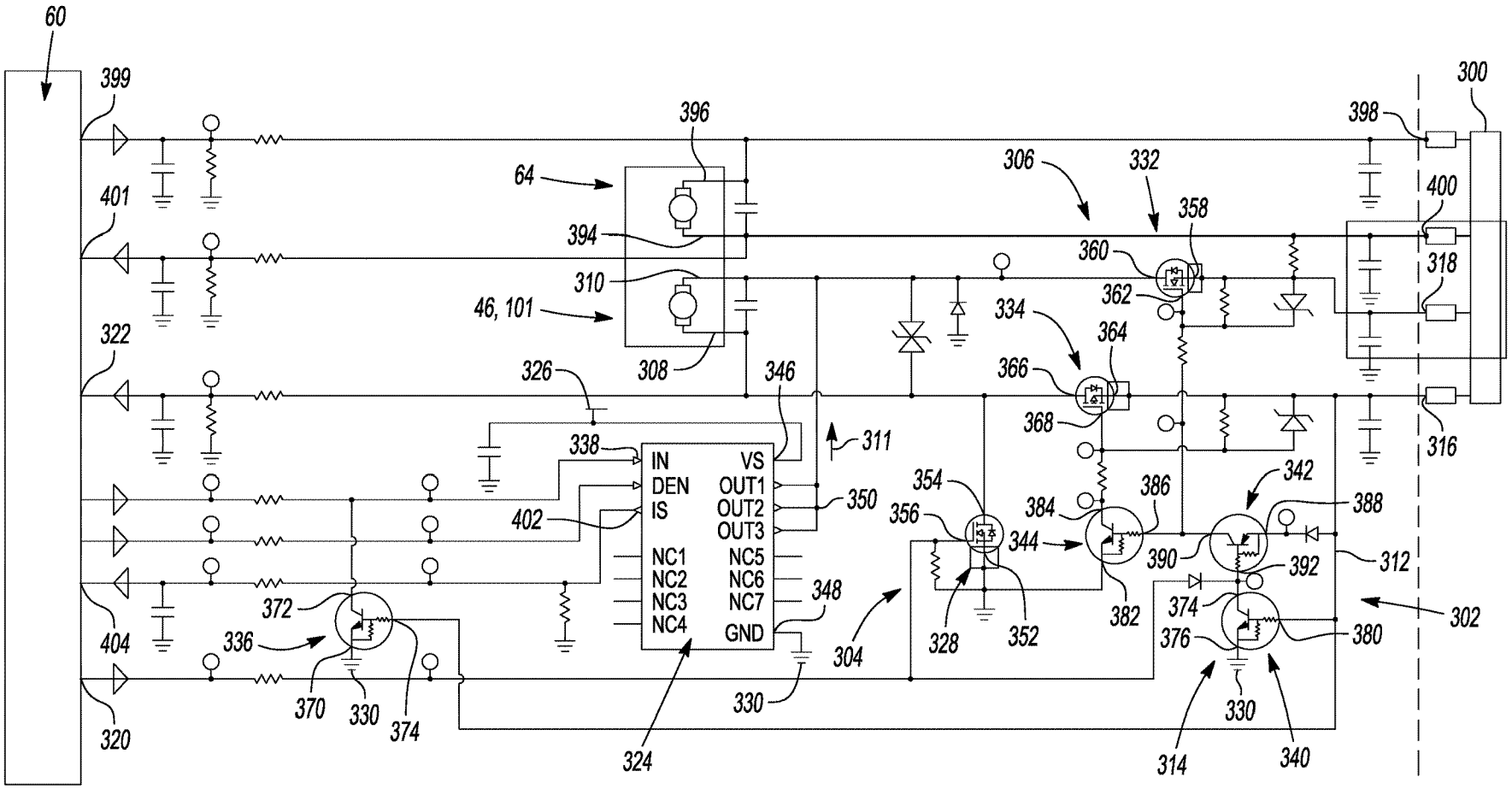
FIG. 9 is a circuit schematic illustrating the isolation system according to aspects of the disclosure.

Continuing to refer to FIG. 8 and also referring to FIG. 9, the isolation system 302 can include a primary motor driving circuit 304 and a secondary motor driving circuit 306 each coupled to the release electric motor 46, 101. Such circuits 304, 306 may be provided on printed circuit board having reference numeral 7 and housed within body 9 of U.S. Pat. No. 10,329,807 as an example, or on another support associated with the latch assembly 10 e.g. within or on the housing of the latch assembly 10. The release electric motor 46, 101 includes a first release motor terminal 308 and a second release motor terminal 310. The secondary motor driving circuit 306 is coupled to the external motor controller 300 (e.g., BCM) that is configured to provide a secondary driving signal 312 to the secondary motor driving circuit 306. The primary controller (e.g., electronic control unit 60) is coupled to the primary motor driving circuit 304 and is configured to monitor the secondary driving signal 312 and control the primary motor driving circuit 304, as well.

The isolation system 302 also includes an isolation logic unit or circuit 314 coupled to the primary and secondary motor driving circuits 304, 306 and the primary controller 60 and the external motor controller 300. The isolation logic unit 314 is configured to isolate the primary motor driving circuit 304 from the secondary motor driving circuit 306 in response to the external motor controller 300 providing the secondary driving signal 312 to the secondary motor driving circuit 306.

The external motor controller 300 includes a first release output 316 and a second release output 318 and the primary controller 60 includes a low side output 320 and a high side output 322. The high side output 322 may be used by the primary controller 60 for diagnostics of the release electric motor 46, 101. The primary motor driving circuit 304 includes a primary high side switch 324 (e.g., high side switch of an internal motor driver) coupled to a power supply 326 and to the second release motor terminal 310 is and controlled by one of the high side output 322 of the primary controller 60 (e.g., via pulse width modulation (PWM)) and the isolation logic unit 314. The primary motor driving circuit 304 also includes a primary low side switch 328 (e.g., low side switch of the internal motor driver) coupled to an electrical ground 330 and the first release motor terminal 308 and is controlled by one of the low side output 320 of the primary controller 60 and the isolation logic unit 314.

The secondary motor driving circuit 306 includes a secondary high side switch 332 coupled to the external motor controller 300 and to the second release motor terminal 310 and is controlled by one of the second release output 318 and the isolation logic unit 314. Additionally, the secondary motor driving circuit 306 includes a secondary low side switch 334 is coupled to the first release output 316 and the first release motor terminal 308 and is controlled by one of the first release output 316 and the isolation logic unit 314.

Continuing to refer to FIG. 9, the isolation logic unit 314 includes a first primary disable switch 336 coupled to the electrical ground 330 and a primary high side enable input 338 of the primary high side switch 324. The first primary disable switch 336 is controlled by the first release output 316 of the external motor controller 300 for grounding the primary high side enable input 338 of the primary high side switch 324 to disable the primary high side switch 324 in response to the external motor controller 300 providing the secondary driving signal 312 to the secondary motor driving circuit 306.

The isolation logic unit 314 also includes a second primary disable switch 340 that is coupled to the electrical ground 330 and to the low side output 320 of the primary controller 60. The second primary disable switch 340 is controlled by the first release output 316 of the external motor controller 300 for grounding the low side output 320 of the primary controller 60 to disable the primary low side switch 328 in response to the external motor controller 300 providing the secondary driving signal 312 to the secondary motor driving circuit 306.

In addition, the isolation logic unit 314 includes a second secondary enable switch 342 coupled to the first release output 316 and the secondary high side switch 332. The second secondary enable switch 342 is controlled by the second primary disable switch 340 for turning on the secondary high side switch 332 and coupling the second release output 318 of the external motor controller 300 to the second release motor terminal 310 to enable the external motor controller 300 to operate the release motor in response to the external motor controller 300 providing the secondary driving signal 312 to the secondary motor driving circuit 306. The isolation logic unit 314 additionally includes a first secondary enable switch 344 coupled to the electrical ground 330 and the secondary low side switch 334. The first secondary enable switch 344 is controlled by the first primary disable switch 336 for turning on the secondary low side switch 334 and coupling the first release output 316 of the external motor controller 300 to the first release motor terminal 308 to enable the external motor controller 300 to operate the release motor in response to the external motor controller 300 providing the secondary driving signal 312 to the secondary motor driving circuit 306.

Describing the primary motor driving circuit 304 in more detail, the primary high side switch 324 is an integrated high side power switch including a supply voltage input 346 coupled to the power supply 326 and a ground input 348 coupled to the electrical ground 330 and the primary high side enable input 338 coupled to the first primary disable switch 336 and an output 350 coupled to the second release motor terminal 310. The primary low side switch 328 is a field effect transistor including a primary low source 352 coupled to the electrical ground 330 and a primary low drain 354 coupled to the first release motor terminal 308 and a primary low gate 356 coupled to the low side output 320 of the primary controller 60.

In addition, looking at the secondary motor driving circuit 306 more specifically, the secondary high side switch 332 is a field effect transistor including a secondary high source 358 coupled to second release output 318 of the external motor controller 300 and a secondary high drain 360 coupled to the second release motor terminal 310 and a secondary high gate 362 coupled to the second secondary enable switch 342 and the second release output 318 of the external motor controller 300. Additionally, the secondary low side switch 334 is a field effect transistor including a secondary low source 364 coupled to first release output 316 of the external motor controller 300 and a secondary low drain 366 coupled to the first release motor terminal 308 and a secondary low gate 368 coupled to the first secondary enable switch 344 and to the first release output 318 of the external motor controller 300.

Describing the isolation logic unit 314 in more detail, the first primary disable switch 336 is a bipolar junction transistor including a first primary disable emitter 370 coupled to the electrical ground 330 and first primary disable collector 372 coupled to the primary high side enable input 338 of the primary high side switch 324 and a first primary disable base 374 coupled to the first release output 316 of the external motor controller 300. The first primary disable base 374 can, for example, be used to turn off the primary high side switch 324 if the first release output 316 of the external motor controller 300 goes high (i.e., a positive voltage is output by the external motor controller 300) The second primary disable switch 340 is a bipolar junction transistor including a second primary disable emitter 376 coupled to the electrical ground 330 and a second primary disable collector 378 coupled to the low side output 320 of the primary controller 60 and a second primary disable base 380 coupled to the first release output 316 of the external motor controller 300. The first secondary enable switch 344 is a bipolar junction transistor including a first secondary enable emitter 382 coupled to the electrical ground 330 and a first secondary enable collector 384 coupled to the secondary low gate 368 of the secondary low side switch 334 and a first secondary enable base 386 coupled to the first primary disable collector 372 of the first primary disable switch 336. The second secondary enable switch 342 is a bipolar junction transistor including a second secondary enable emitter 388 coupled to the first release output 316 and a second secondary enable collector 390 coupled to secondary high gate 362 of the secondary high side switch 332 and a second secondary enable base 392 coupled to second primary disable collector 378 of the second primary disable switch 340 and the low side output 320 of the primary controller 60.

As discussed above, the closure latch assembly 10 can further include a power lock actuator 64, 66 including a lock electric motor 64 for controlling a connection between the inside release lever 26 and the pawl release lever 40 operatively connected to the pawl 32. The lock electric motor 64 includes a first lock motor terminal 394 and a second lock motor terminal 396. The external motor controller 300 includes a first lock output 398 coupled to the second lock motor terminal 396 and a second lock output 400 coupled to the first lock motor terminal 394. The lock electric motor 64 is configured to be driven by the by one of the second lock output 400 and the second release output 318 of the external motor controller 300 and is coupled to the primary controller 60 at terminals 399 and 401 (e.g., for controlling the lock motor 64 and/or for diagnostics of the lock motor 64). So, the isolation system 302 including the isolation logic unit 314 allows the external motor controller 300 to drive the lock motor 64 with a common power release (PR) line (e.g., the first release output 316 of the external motor controller 300 coupled to the high side output 322 of the primary controller 60) during a power reset. The lock lines (e.g., first lock output 398 and the second lock output 400) are switched voltages to drive the direction of the lock motor 64 while the first release output 316 is put to a tristate so that any voltage on the second release output 318 or first lock output 398 does not drive the release motor 46, 101.

Figure 10:
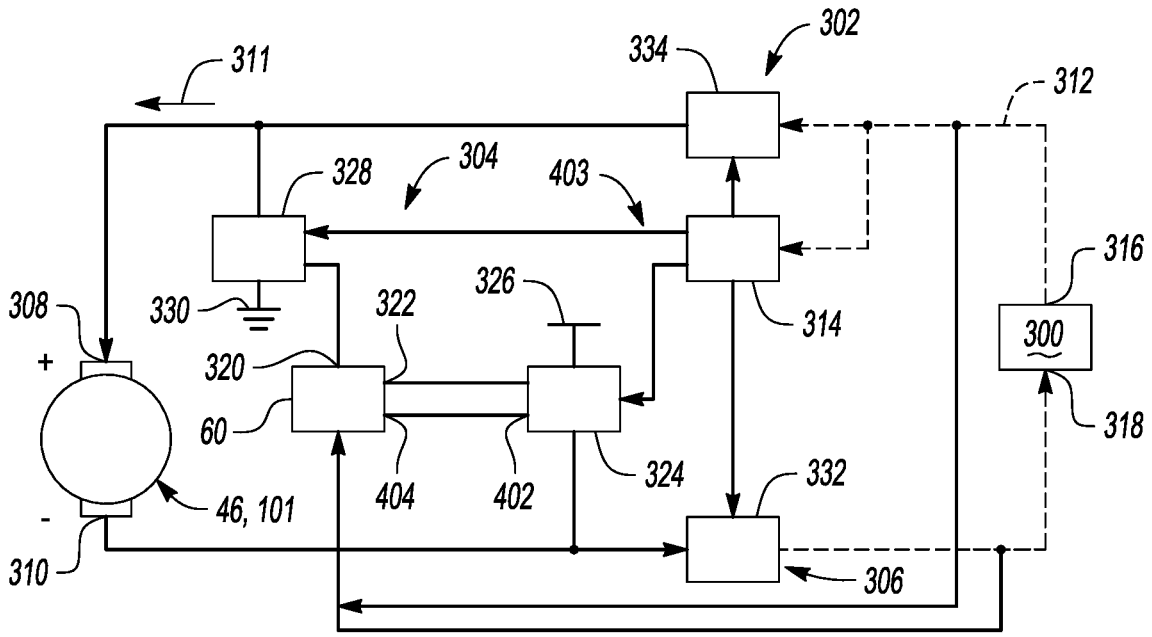
Figure 11:
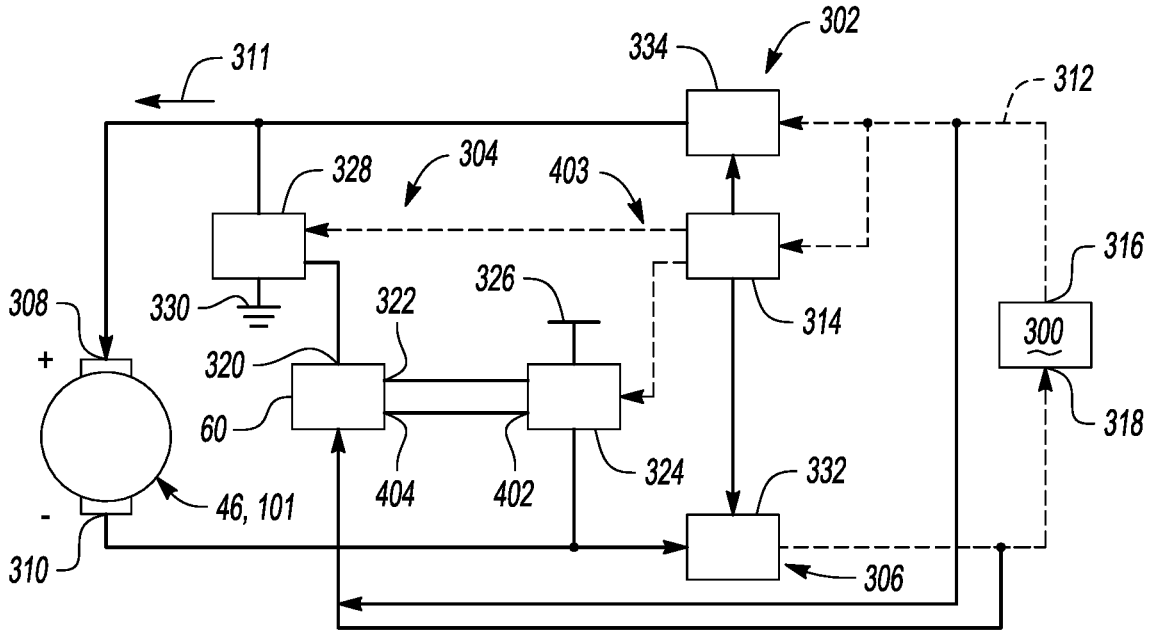
Figure 12:
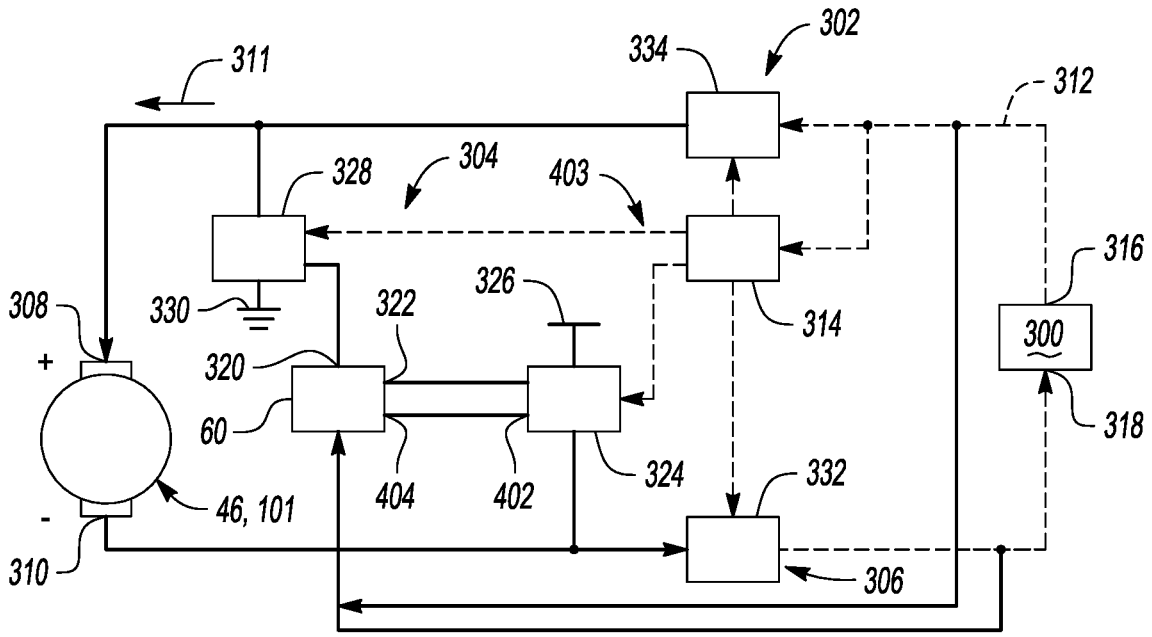
Figure 13:
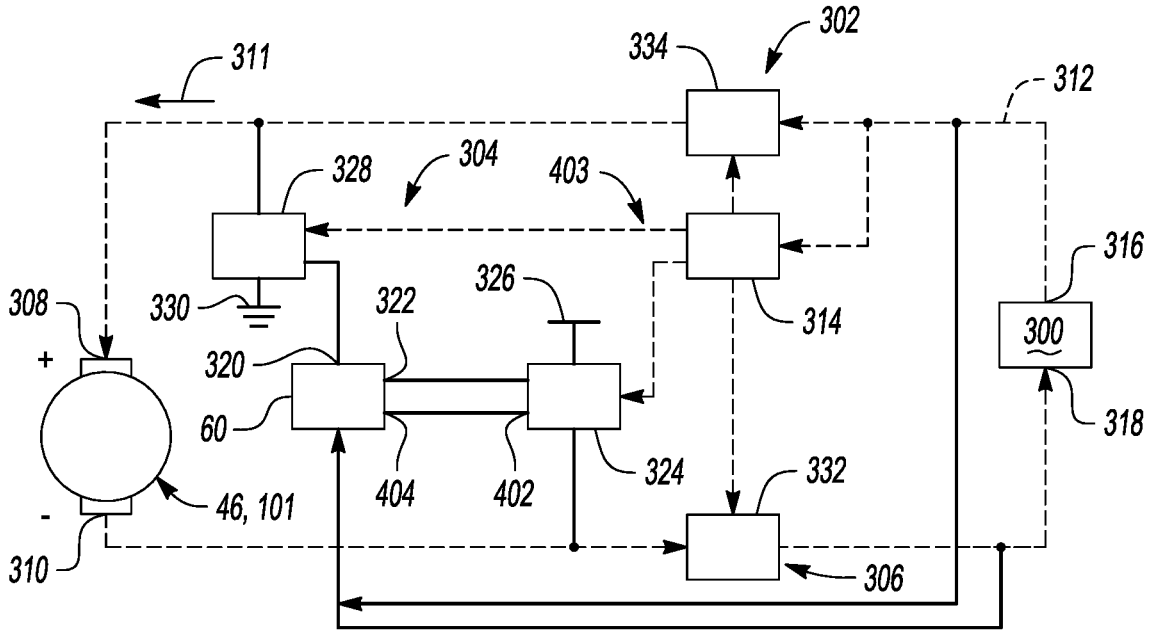

The operation of the isolation system 302 is shown in FIGS. 10-18. Specifically, FIG. 10 shows the external motor controller 300 (e.g., outside unidirectional motor control) providing the secondary driving signal 312 to the secondary motor driving circuit 306. So, the external motor controller 300 provides power to the secondary high side switch 332 and the secondary low side switch 334 through the first release output 316 and the second release output 318. The first release output 316 and the second release output 318 are also coupled to the primary controller 60 so that the primary controller can monitor the secondary driving signal 312. In FIG. 11, the isolation logic unit 314 receives the secondary driving signal 312 from the external motor controller 300 and causes the primary high side switch 324 and the primary low side switch 328 (i.e., the internal drivers of the closure latch assembly 10) to turn off. In other words, an enable override (indicated as 403) turns on. Then, in FIG. 12, with the enable override 403 on and the internal drivers (the primary high side switch 324 and the primary low side switch 328) off, the secondary high side switch 332 and the secondary low side switch 334 can turn on and, as shown in FIG. 13, this enables the external motor controller 300 to drive the release electric motor 46, 101 in a first direction (e.g., the release direction).

Figure 14:
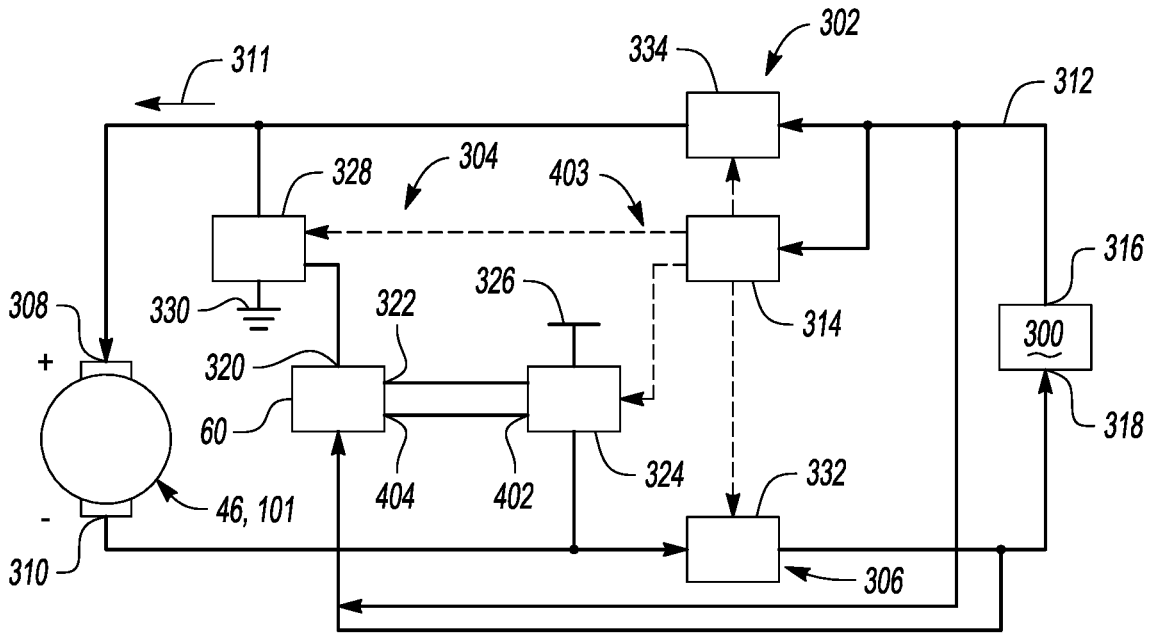
Figure 15:
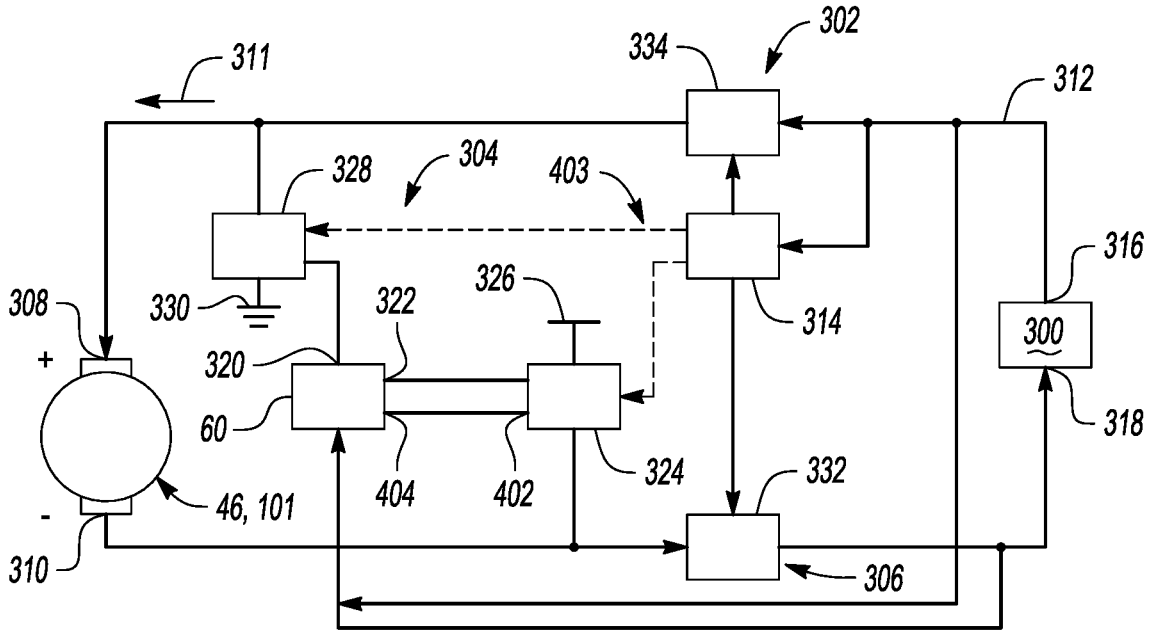
Figure 16:
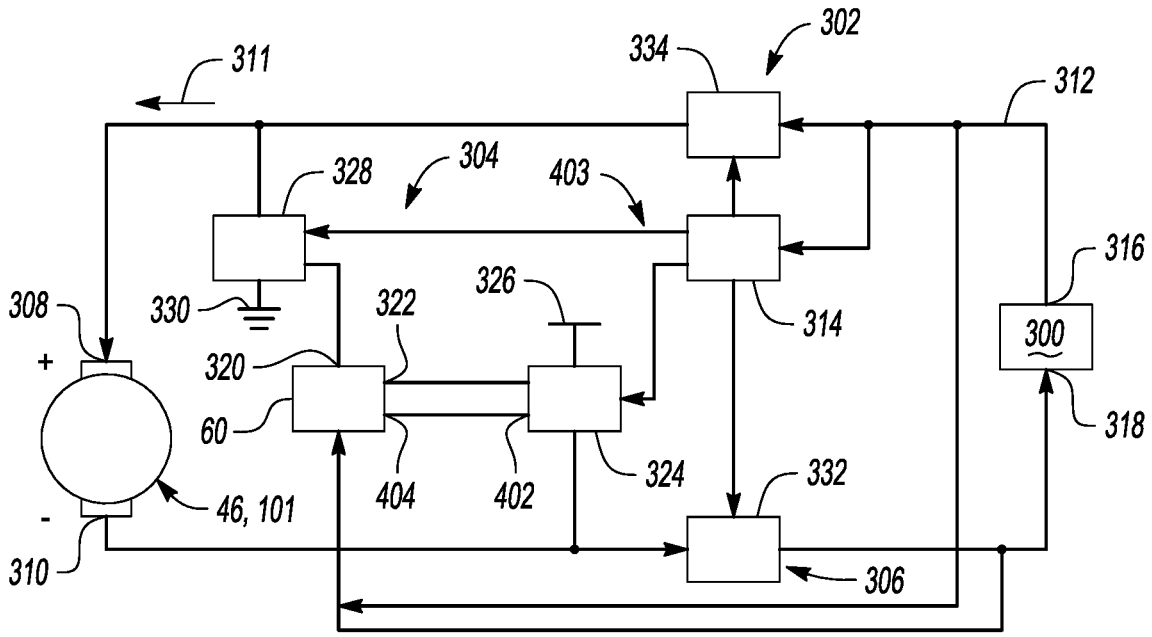
Figure 17:
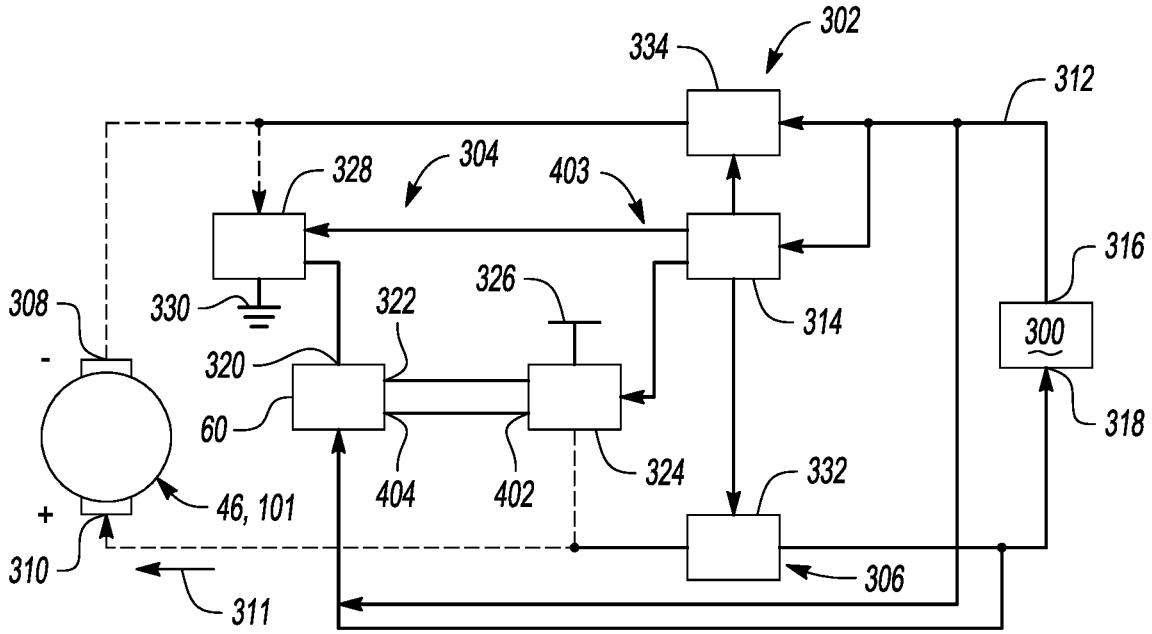

In FIG. 14, the external motor controller 300 stops providing secondary driving signal 312 (i.e., the external motor controller 300 turns off), so as shown in FIG. 15, the enable override 403 is still on and the secondary high side switch 332 and the secondary low side switch 334 turn off. As shown in FIG. 16, the internal drivers (the primary high side switch 324 and the primary low side switch 328) are now isolated and can now operate, without the possibility of turning on with an opposite polarity to the secondary high side switch 332 and the secondary low side switch 334 because the enable override 403 is off. In FIG. 17, the release electric motor 46, 101 is driven by the primary high side switch 324 and the primary low side switch 328 as commanded by the primary controller 60 (e.g., ECU 60) with an opposite polarity, causing the release electric motor 46, 101 to rotate in a second direction (e.g., the reset direction).

Figure 20:
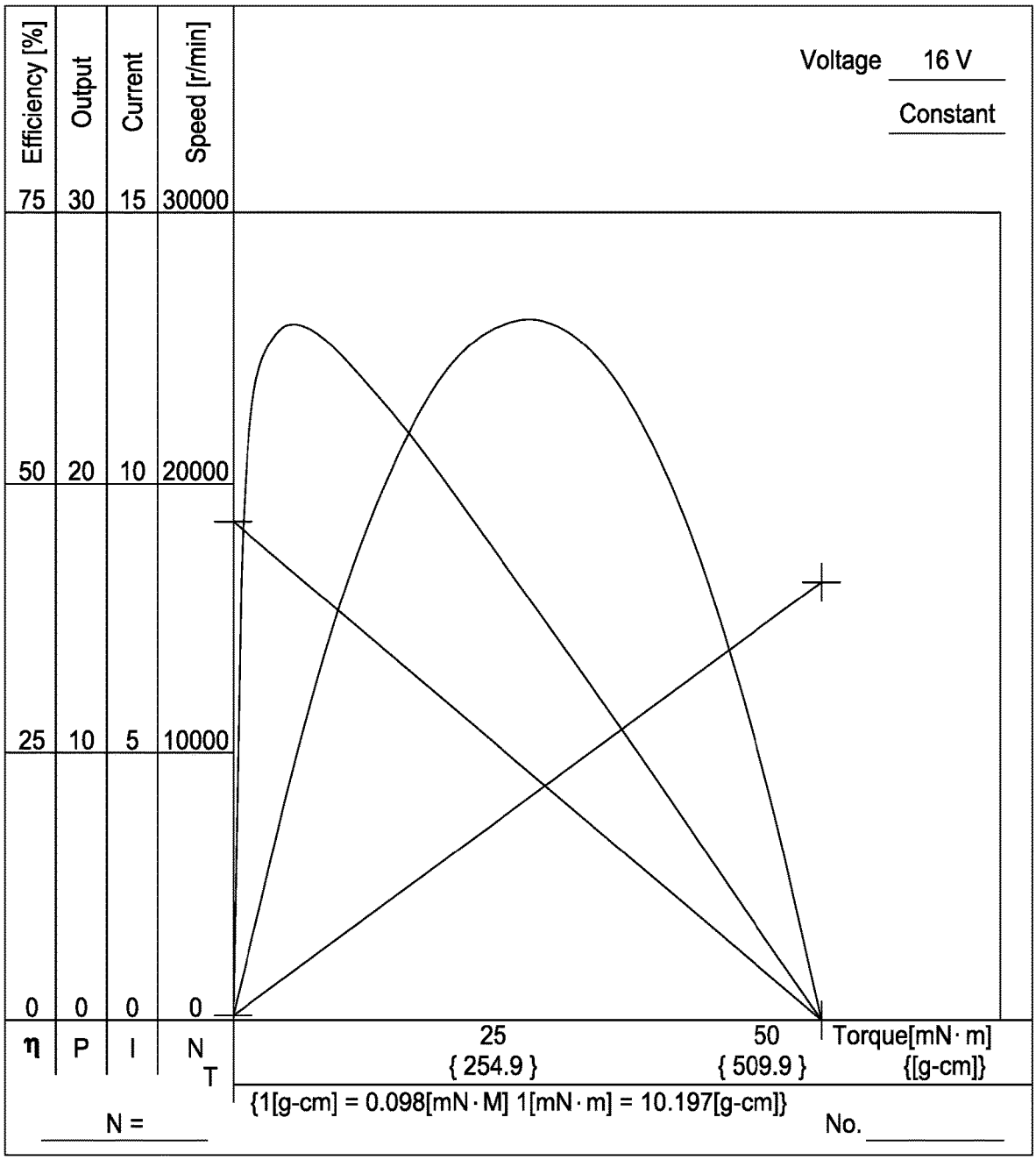
FIG. 20 shows a torque curve of an example release electric motor of the closure latch assembly according to aspects of the disclosure.

As shown in FIG. 18, if the external motor controller 300 again sends the secondary driving signal 312 (i.e., the external motor controller 300 turns back on), the enable override will again be activated to turn off the primary high side switch 324 and the primary low side switch 328 before allowing the secondary high side switch 332 and the secondary low side switch 334 to turn on. The isolation logic unit 314 can be entirely implemented without software and will operate fast enough that the external motor controller 300 will be seamlessly isolated from the release electric motor 46, 101. In other configurations, the isolation logic unit 314 can be implemented in software and/or a combination of software and hardware. The primary high side switch 324 further includes a current sense output 402 coupled to a current sense input 404 of the primary controller 60. Thus, the primary controller 60 can sense an amount of current supplied to the release electric motor 46, 101 when the primary high side switch 324 drives the release electric motor 46, 101. According to an aspect, the primary high side switch 324 is the Infineon® BTS7040-1EPA. FIG. 19 illustrates a table showing example sense ratios for this specific primary high side switch 324. While the release electric motor 46, 101 is driven by the primary high side switch 324 and the primary low side switch 328 as commanded by the primary controller 60 with the opposite polarity (i.e., back driven), the primary high side switch 324 monitors the current. Since there is no real load on the release electric motor 46, 101, the current is low (e.g., approximately 1.5-2.0 Amperes) and stall is approximately 10 Amperes, so it is easy to determine when stall is reached. FIG. 20 shows a torque curve of an example release electric motor 46, 101. For example, the max stall at −40 degrees Celsius with 16 Volt operation is 8.18 Amperes.

The primary controller 60, and for example the latch controller, can be configured to supply of the primary driving signal 311 to the electric motor based on the supply of the secondary driving signal 312 to the electric motor 46, 101. For example and as described in exemplary manners herein above, the primary controller 60 may cease providing the primary driving signal 311 to the to the electric motor 46, 101 based on the controller 60 detecting the supply of the secondary driving signal 312, or in other words interrupt the supply of the primary driving signal 311, and then switch between the supply of the primary driving signal 311 to the secondary driving signal 312 to the electric motor 46, 101. In other words, the controller 60 is configured to prevent supply of the secondary driving signal 312 to the electric motor 46, 101 while the electric motor electric motor 46, 101 is being supplied with the primary driving signal 311 to avoid two or more sources of drive signals being simultaneously provided to the electric motor 46, 101.

The primary controller 60 may provide the primary driving signal 311 to the electric motor 46, 101 based on the controller 60 detecting the supply of the secondary driving signal 312 having ceased, which for may for example may be the primary driving signal 311 supplied to cause the motor 46, 101 to operate in a direction so as to reset of the actuatable mechanism. The primary driving signal 311 may be generated locally, for example locally to the vehicle latch assembly 10 using the main vehicle power source as conditioned by switches housing within the housing of the assembly 10 and PWM switching techniques described herein. The primary controller 60 may provide the primary driving signal 311 to the electric motor 46, 101 based on the controller 60 detecting the supply of the secondary driving signal 312 having ceased, which for may for example may be the primary driving signal 311 supplied to continue to actuate the actuatable mechanism, such as to continue to power release the latch assembly 10. For example the controller 60 may monitor and supply the secondary driving signal 312 to the electric motor 46, 101 to cause the power release gear to rotate in a first direction from its neutral/home position to the first released position where the power release gear is held in the released position for a period of time e.g. 100 milliseconds, and thereafter the controller 60 may monitor and detect a ceasing of the secondary driving signal 312 being supplied by the external motor controller 300 to the electric motor 46, 101 and supply the primary driving signal 311 to the electric motor 46, 101 to cause the power release gear to be held in the released position for a period of time e.g. 200 milliseconds, therefore providing a snow load function (for example the pawl 32 of the latch 10 is prevented from returning into a position where it may engage the ratchet 30) of the latch assembly 10 without the external motor controller 300 having to modify the secondary driving signal 312 or without receiving feedback information from the controller 60. Therefore the controller 60 may determine which of the primary driving signal 311 and the secondary driving signal 312 is selected and/or provided to the electric motor 46, 101 when power is available to be supplied to electric motor 46, 101 from the vehicle power source, such as a main battery, or in other words when an emergency mode does not exist and the main vehicle power is available. Controller 60 may therefore be configured to determine when cessation of supply of the secondary driving signal 312 is not due to a vehicle main power source interruption by for example monitoring the voltage levels of the power supply lines to the latch assembly 10 to determine no emergency mode exists. For example, in a configuration where the latch assembly 10 is in communication with an obstacle detection sensor or system for example a capacitive based, contact sensing based, or non-contact based sensor or system, the controller 60 may override power release signal, for example a secondary driving signal 312, received from the external controller 300. Therefore, controller 60 may determine that the secondary driving signal 312 is ceased when the vehicle power (e.g. a main vehicle power source such as the vehicle battery) is still available and use the vehicle power as a source of the primary driving signal 311. In another configuration the primary driving signal 311 may be generated from a backup energy source, such as a super capacitor provided within the housing of the latch assembly 10. The primary controller 60, and for example the latch controller, can be configured in other manners to control supply of the primary driving signal 311 to the electric motor based on the supply of the secondary driving signal 312 to the electric motor 46, 101, and for example may include cutting or ceasing supply of the secondary driving signal 312 to the electric motor 46, 101 after a period of time before supply of the secondary driving signal 312 is ceased by the external controller 300, and preventing the supply of the secondary driving signal 312 to the electric motor 46, 101 for resetting the actuatable mechanism to allow the controller 60 to determine when to supply the primary driving signal 311 for controlling the reset operation at a particular movement independently from the decision or control (through supply of the secondary driving signal 312) of the external controller 300 to reset the actuatable mechanism. As a result the control of the actuatable mechanism may be based on and independent from signals received from the external controller 300 as determined by the controller 60, and external controller 300 does not require any feedback signals received from the controller 60 nor require an modification or adaptation to the secondary driving signal 312 for providing the functionality controlled by the controller 60. In another possible or additional configuration, the supply of the secondary driving signal 312 to the electric motor 46, 101 may cause an override of the controller 60 supplying the electrical motor with the primary driving signal 311. Therefore no feedback signal indicating the operating status of the electric motor 46, 10 e.g. operating in a direction, at a certain time, at a certain speed for example, is required to be provided from the controller 60 to the external controller 300.

Figure 21:
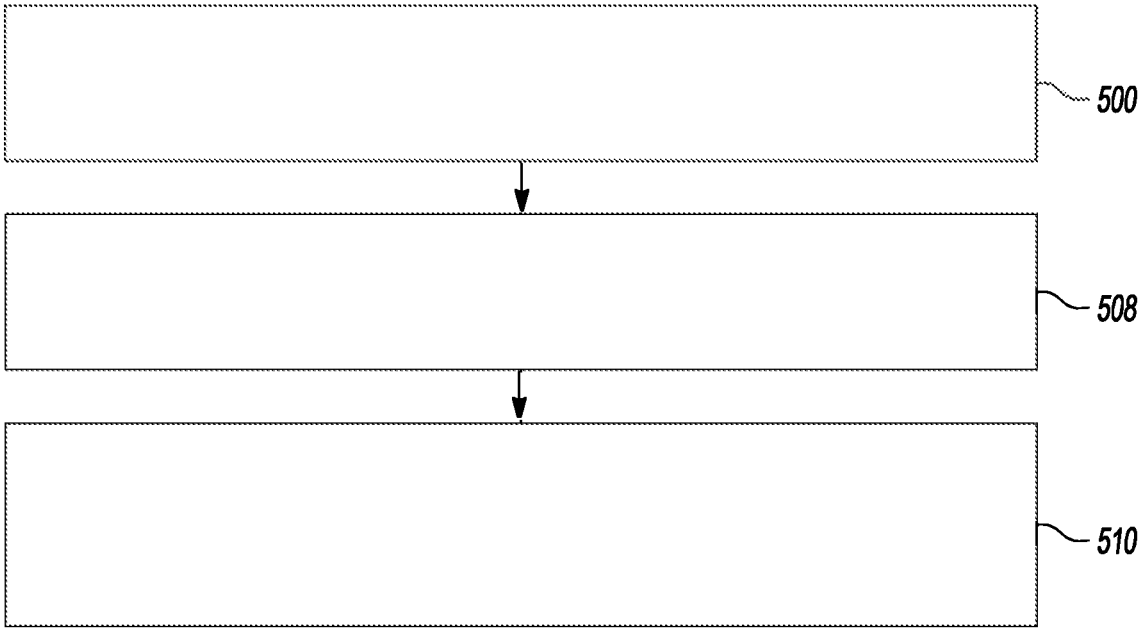
FIGS. 21 and 22A-22B illustrate steps of a method of isolating a primary motor driving circuit and a secondary motor driving circuit of the isolation system according to aspects of the disclosure.
Figure 22A:
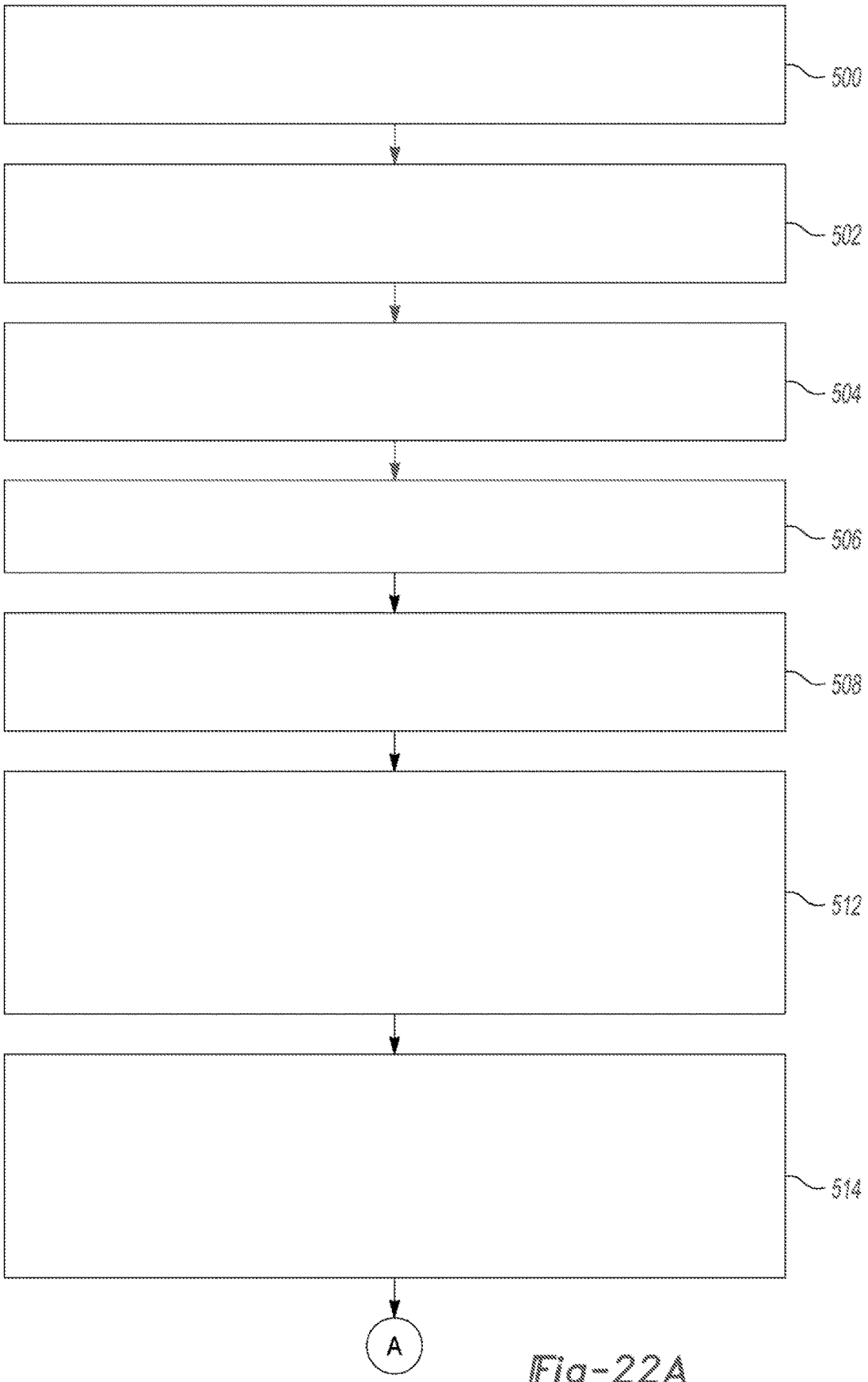
Figure 22B:
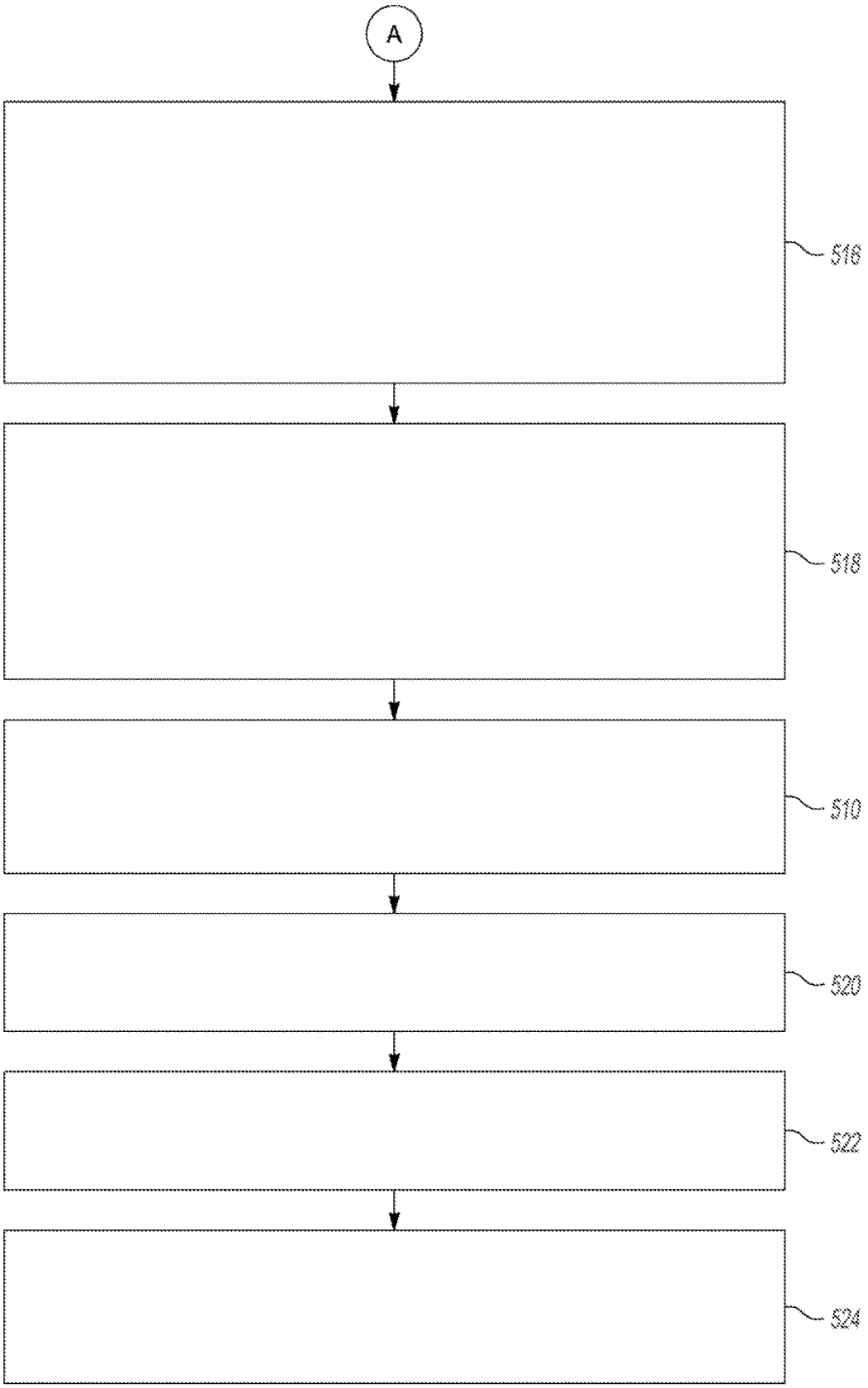

As best shown in FIGS. 21 and 22A-22B, a method of isolating the primary motor driving circuit 304 and the secondary motor driving circuit 306, each independently driving the release electric motor 46, 101 of the actuatable mechanism is also provided. The method includes the step of 500 providing a secondary driving signal 312 to the secondary motor driving circuit 306 using an external motor controller 300 coupled to the secondary motor driving circuit 306. The method proceeds by 502 controlling a secondary high side switch 332 coupled to the external motor controller 300 and to the second release motor terminal 310 using one of the second release output 318 and the isolation logic unit 314. Next, 504 controlling a secondary low side switch 334 coupled to the first release output 316 and the first release motor terminal 308 using one of the first release output 316 and the isolation logic unit 314. The method can further include the step of 506 monitoring the secondary driving signal 312 using the primary controller 60 coupled to the isolation logic unit 314 and the primary motor driving circuit 304.

The method can also include the step of 508 receiving the secondary driving signal 312 using an isolation logic unit 314 coupled to the primary and secondary motor driving circuits 304, 306 and the external motor controller 300. The method continues with the step of 510 isolating the primary motor driving circuit 304 being controlled by a primary controller 60 from the secondary motor driving circuit 306 using the isolation logic unit 314 in response to the external motor controller 300 providing the secondary driving signal 312 to the secondary motor driving circuit 306. The step of 510 isolating the primary motor driving circuit 304 being controlled by the primary controller 60 from the secondary motor driving circuit 306 using the isolation logic unit 314 in response to the external motor controller 300 providing the secondary driving signal 312 to the secondary motor driving circuit 306 includes the step of 512 controlling a first primary disable switch 336 coupled to the electrical ground 330 and a primary high side enable input 338 of the primary high side switch 324 using the first release output 316 of the external motor controller 300 to ground the primary high side enable input 338 of the primary high side switch 324 and disable the primary high side switch 324 in response to the external motor controller 300 controlling the secondary motor driving circuit 306 with the secondary driving signal 312. The method continues by 514 controlling a second primary disable switch 340 coupled to the electrical ground 330 and to the low side output 320 of the primary controller 60 using the first release output 316 of the external motor controller 300 to ground the low side output 320 of the primary controller 60 and disable the primary low side switch 328 in response to the external motor controller 300 controlling the secondary motor driving circuit 306 with the secondary driving signal 312. Next, 516 controlling a second secondary enable switch 342 coupled to the first release output 316 and the secondary high side switch 332 using the second primary disable switch 340 to turn on the secondary high side switch 332 and couple the second release output 318 of the external motor controller 300 to the second release motor terminal 310 and enable the external motor controller 300 to operate the release electric motor 46, 101 in response to the external motor controller 300 controlling the secondary motor driving circuit 306 with the secondary driving signal 312. The method then includes the step of 518 controlling a first secondary enable switch 344 coupled to the electrical ground 330 and the secondary low side switch 334 using the first primary disable switch 336 to turn on the secondary low side switch 334 and couple the first release output 316 of the external motor controller 300 to the first release motor terminal 308 and enable the external motor controller 300 to operate the release electric motor 46, 101 in response to the external motor controller 300 controlling the secondary motor driving circuit 306 with the secondary driving signal 312.

Once the driving circuits are isolated, the method further includes the step of 520 controlling a primary high side switch 324 coupled to a power supply 326 and to the second release motor terminal 310 using one of the high side output 322 of the primary controller 60 and the isolation logic unit 314. The method continues with the step of 522 controlling a primary low side switch 328 coupled to an electrical ground 330 and the first release motor terminal 308 using one of the low side output 320 of the primary controller 60 and the isolation logic unit 314. The method can also include the step of 524 sensing an amount of current supplied to the release electric motor 46, 101 from a current sense output 402 of the primary high side switch 324 when the primary high side switch 324 drives the release electric motor 46, 101 using a current sense input 404 of the primary controller 60.

Therefore, the isolation system 302 can be used as part of the closure latch assembly 10 described above that includes the latch mechanism 30, 32 operable in a first state to locate the closure panel 12 in a first position and in a second state to locate the closure panel 12 in a second position. The power actuator used with the isolation system 302 can, for example, include the actuatable mechanism 104, 106, 108 being operable in a non-actuated state to permit the latch mechanism 30, 32 to operate in its first state and in an actuated state to shift the latch mechanism 30, 32 from its first state into its second state. The isolation system 302 advantageously prevents short circuits in instances when the primary controller 60 attempts to drive the release electric motor 46, 101 in one direction while the BCM 300 is simultaneously attempting to drive the release electric motor 46, 101 in the opposite direction. It should be understood that the isolation system 302 could alternatively be used as part of another type of power actuator besides that used in closure latch assembly 10.

Figure 23:
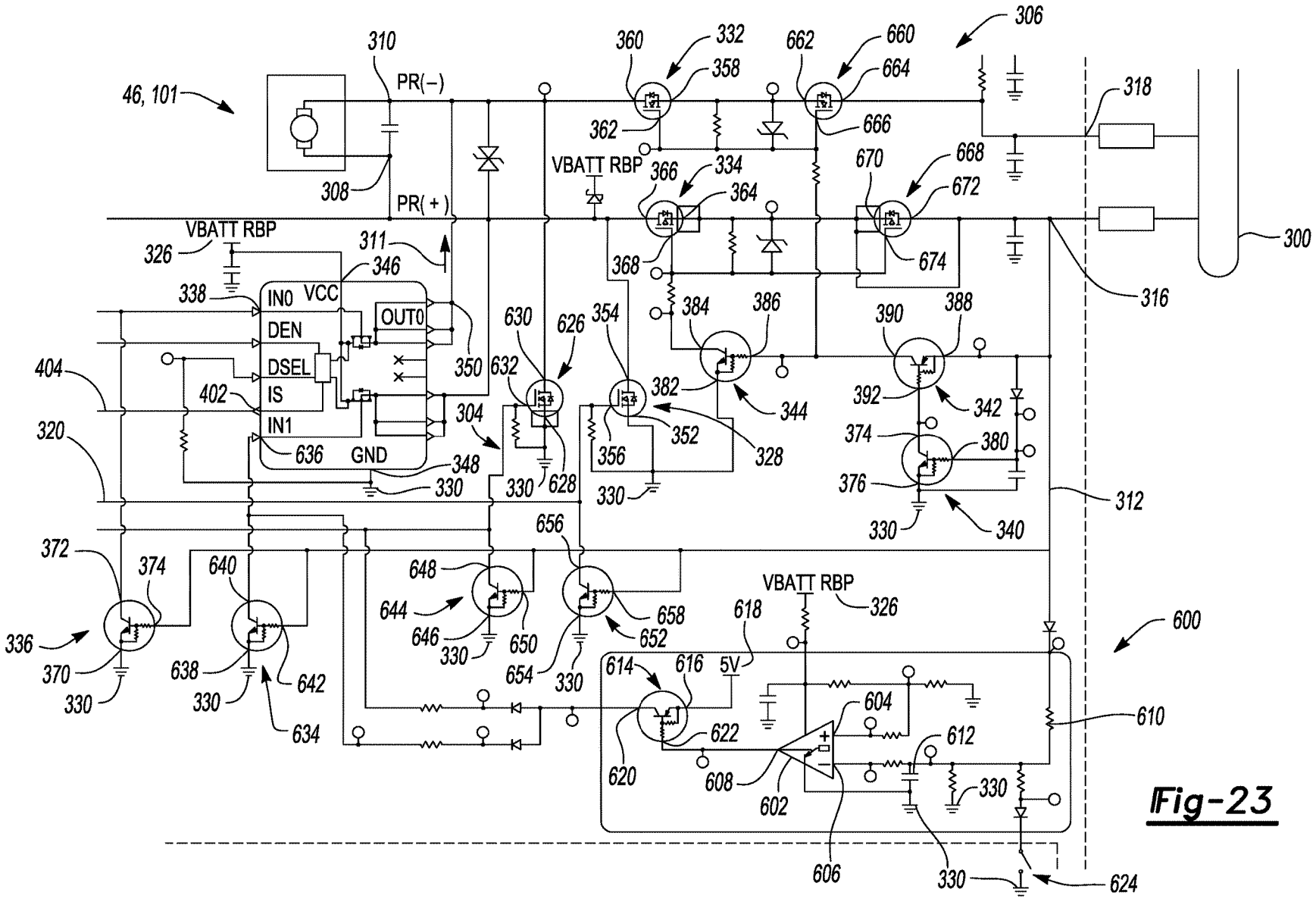
FIG. 23 is a circuit schematic illustrating the isolation system including a timer circuit according to aspects of the disclosure.
Figure 24:
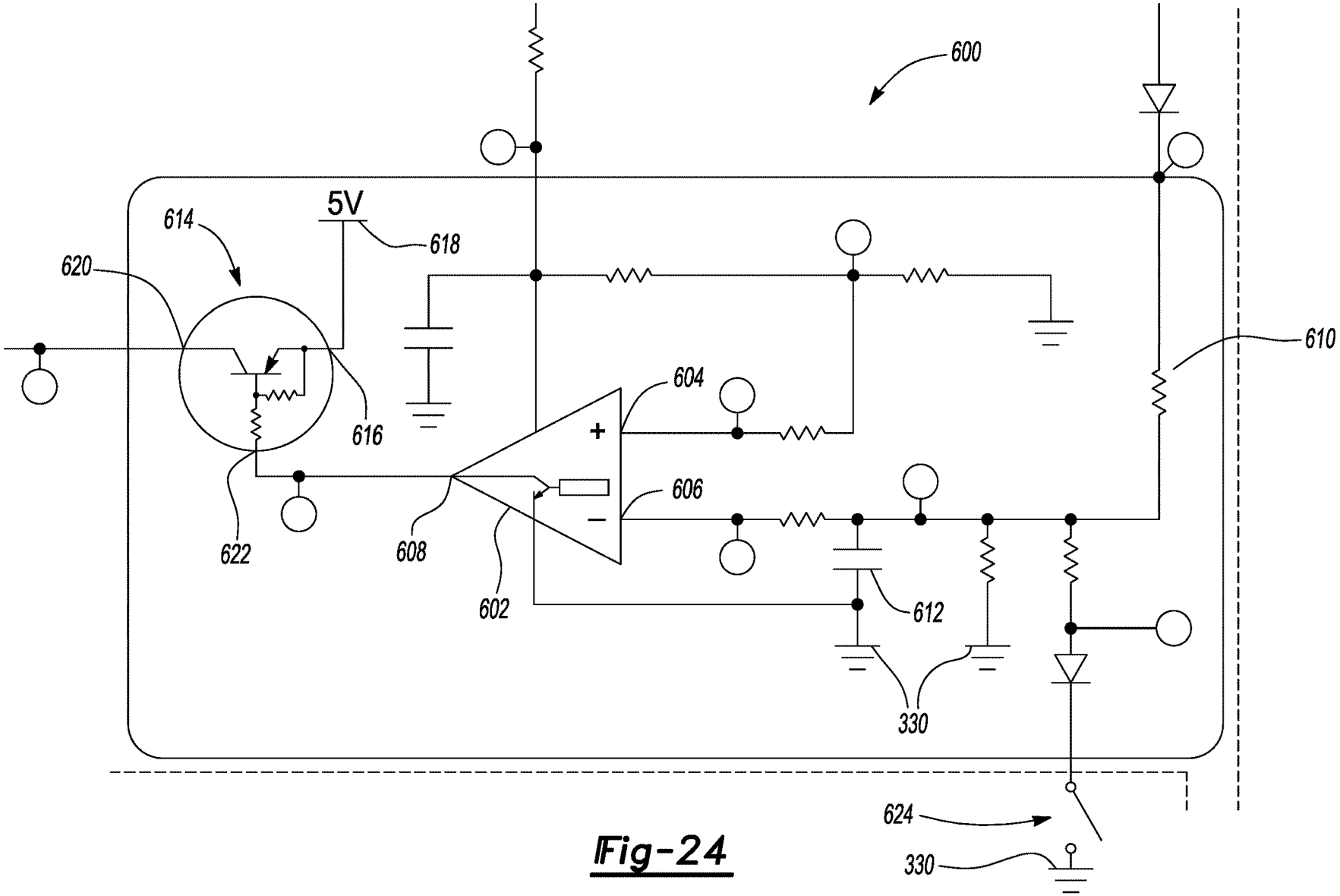
FIG. 24 is a circuit schematic illustrating the timer circuit of the isolation system according to aspects of the disclosure.

Referring now to FIGS. 23 and 24, the isolation system 302 for the release electric motor 46, 101 of the actuatable mechanism is shown to additionally include a timer circuit 600 coupled to the external motor controller 300 and the primary motor driving circuit 304 for providing an RC (resistor and capacitor) delay. The timer circuit 600 is configured to receive the secondary driving signal 312 from the external motor controller 300 and enable the primary controller 60 to control the primary motor driving circuit 304 to drive the release electric motor 46, 101 for a predetermined amount of time (e.g., 500 milliseconds) independent of a duration of the secondary driving signal 312. In more detail, the timer circuit 600 includes a comparator 602 (e.g., Texas Instruments™ TLV1701QDBVRQ1) having a noninverting input 604 coupled to the power supply 326 and an inverting input 606 and a comparator output 608. The timer circuit 600 also includes a timer resistor 610 connected between the first release output 316 and a timer capacitor 612 connected between the inverting input 606 and the electrical ground 330 and configured to be charged by the secondary driving signal 312 through the timer resistor 610. The comparator 602 is configured to compare a capacitor voltage at the noninverting input 604 to a power supply voltage at the inverting input 606 and output a digital one at the comparator output 608 in response to the capacitor voltage being greater than the power supply voltage and output a digital zero at the comparator output 608 in response to the capacitor voltage being less than the power supply voltage. So the timer circuit 600 allows for the operation of the release electric motor 46, 101 (e.g., for latch power release) for a duration determined by the timer circuit 600 independently from the secondary driving signal 312 from the external motor controller 300 (e.g., BCM).

The timer circuit 600 also includes a timer switch 614 connected to the comparator output 608 to provide a timer output signal delayed by the predetermined amount of time. The timer switch 614 is a bipolar junction transistor having a timer emitter 616 connected to a logic high voltage 618 (e.g., 5 volts) and a timer collector 620 and a timer base 622 connected to the comparator output 608 to provide the timer output signal at the timer collector 620. An open indication switch 624 detects a position of a ratchet of the actuatable mechanism. The open indication switch 624 is closed when the ratchet is in an open position. The open indication switch 624 is open when the ratchet is in a closed position. The open indication switch 624 is coupled to the electrical ground 330 and to the timer capacitor 612 of the timer circuit 600 to discharge the timer capacitor 612 to cause the operation of the release electric motor 46, 101 during the predetermined amount of time to cease.

So, the primary controller 60 is configured to operate the primary motor driving circuit 304 for the predetermined amount of time. The primary controller 60 is also configured to determine whether the release electric motor 46, 101 has transitioned a corresponding actuatable mechanism (e.g., actuatable mechanism 104, 106, 108) to release before the expiration of the predetermined amount of time. The primary controller 60 then returns to the step of operating the primary motor driving circuit 304 in response to determining that the actuatable mechanism is not released before the expiration of the predetermined amount of time. The primary controller 60 is also configured to stop control of the release electric motor 46, 101 by the primary motor driving circuit 304 in response to determining that the actuatable mechanism is released before the expiration of the predetermined amount of time (e.g., using the open indication switch 624). Thus, the release electric motor 46, 101 can be controlled at the latch level (e.g., by the primary controller 60) for an extended fixed amount of time to ensure that the pawl does not get stuck in a secondary position during a power release. Typically, the external motor controller 300 (e.g., BCM) will send a pulse (i.e., secondary driving signal 312) to initiate the power release; however when the pulse ends, the latch (e.g., primary controller 60) will itself decide how to release. The decision can for example by linked to a sensing of a ratchet position switch (e.g., open indication switch 624) when movement out of secondary is detected.

So, the latch (e.g., primary controller 60) locally makes decisions about how the triggering signal (e.g., secondary driving signal 312) is carried out by the latch. Therefore, for example, the operation of the release electric motor 46, 101 can be ended before the secondary driving signal 312 ends, since the primary controller 60 (i.e., the latch) detects the position of the ratchet (e.g., using the open indication switch 624) and thus, the life of the release electric motor 46, 101 can be extended or unnecessary stall avoided.

Additionally, referring to FIG. 23, the isolation logic unit 314 further includes a terminal control switch 626 coupled to the electrical ground 330 and the second release motor terminal 310 of the release electric motor 46, 101 and controlled by the timer output signal at the timer collector 620 for grounding the second release motor terminal 310 in response to the timer output signal being a logic high voltage (e.g., 5 volts). The terminal control switch 626 is a field effect transistor that includes a terminal control source 628 coupled to the electrical ground 330, a terminal control drain 630 coupled to the second release motor terminal 310 of the release electric motor 46, 101, and a terminal control gate 632 coupled to the timer collector 620.

A third primary disable switch 634 is coupled to the electrical ground 330 and a second primary high side enable input 636 of the primary high side switch 324 of the primary motor driving circuit 304. The third primary disable switch 634 is controlled by the first release output 316 of the external motor controller 300 for grounding the second primary high side enable input 636 of the primary high side switch 324 to disable the primary high side switch 324 in response to the external motor controller 300 providing the secondary driving signal to the secondary motor driving circuit 306. The third primary disable switch 634 is a bipolar junction transistor that includes a third primary disable emitter 638 coupled to the electrical ground 330, a third primary disable collector 640 coupled to the second primary high side enable input 636 of the primary high side switch 324 of the primary motor driving circuit 304, and a third primary disable base 642 coupled to the first release output 316 of the external motor controller 300.

A fourth primary disable switch 644 is coupled to the electrical ground 330 and the terminal control switch 626. The fourth primary disable switch 644 is controlled by the first release output 316 of the external motor controller 300 for turning the terminal control switch 626 off in response to the external motor controller 300 providing the secondary driving signal 312 to the secondary motor driving circuit 306. The fourth primary disable switch 644 is a bipolar junction transistor that includes a fourth primary disable emitter 646 coupled to the electrical ground 330, a fourth primary disable collector 648 coupled to the terminal control gate 632 of the terminal control switch 626, and a fourth primary disable base 650 coupled to the first release output 316 of the external motor controller 300.

A fifth primary disable switch 652 is coupled to the electrical ground 330 and the primary low side switch 328 of the primary motor driving circuit 304. The fifth primary disable switch 652 is controlled by the first release output 316 of the external motor controller 300 for turning the primary low side switch 328 off in response to the external motor controller 300 providing the secondary driving signal 312 to the secondary motor driving circuit 306. The fifth primary disable switch 652 is a bipolar junction transistor that includes a fifth primary disable emitter 654 coupled to the electrical ground 330, a fifth primary disable collector 656 coupled to a primary low gate 356 of the primary low side switch 328, and a fifth primary disable base 658 coupled to the first release output 316 of the external motor controller 300.

A supplementary secondary high side switch 660 is coupled between the secondary high side switch 332 of the secondary motor driving circuit 306 and the second release output 318 of the external motor controller 300. The supplementary secondary high side switch 660 is controlled by one of the second release output 318 and the isolation logic unit 314. The supplementary secondary high side switch 660 is a field effect transistor that includes a supplementary secondary high source 662 coupled to a secondary high source 358 of the secondary high side switch 332, a supplementary secondary high drain 664 coupled to second release output 318 of the external motor controller 300, and a supplementary secondary high gate 666 coupled to the isolation logic unit 314.

A supplementary secondary low side switch 668 is coupled between a secondary low side switch 334 of the secondary motor driving circuit 306 and the first release output 316 of the external motor controller 300. The supplementary secondary low side switch 668 is controlled by one of the first release output 316 and the isolation logic unit 314. The supplementary secondary low side switch 668 is a field effect transistor that includes a supplementary secondary low source 670 coupled to the secondary low source 364 of the secondary low side switch 334, a supplementary secondary low drain 672 coupled to first release output 316 of the external motor controller 300, and a supplementary secondary low gate 674 coupled to the isolation logic unit 314.

Figure 25:
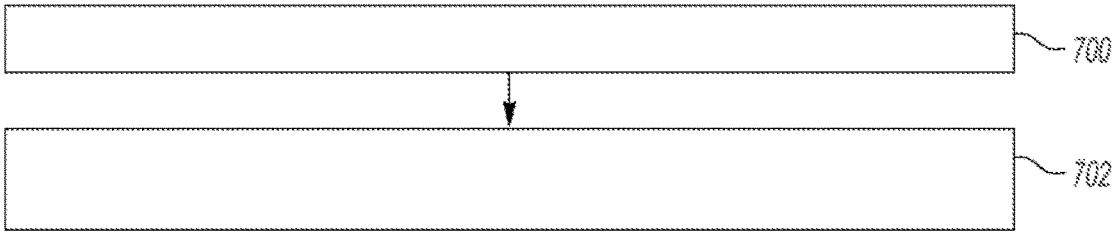
FIGS. 25 and 26 illustrate steps of a method of operating an actuatable mechanism according to aspects of the disclosure.
Figure 26:
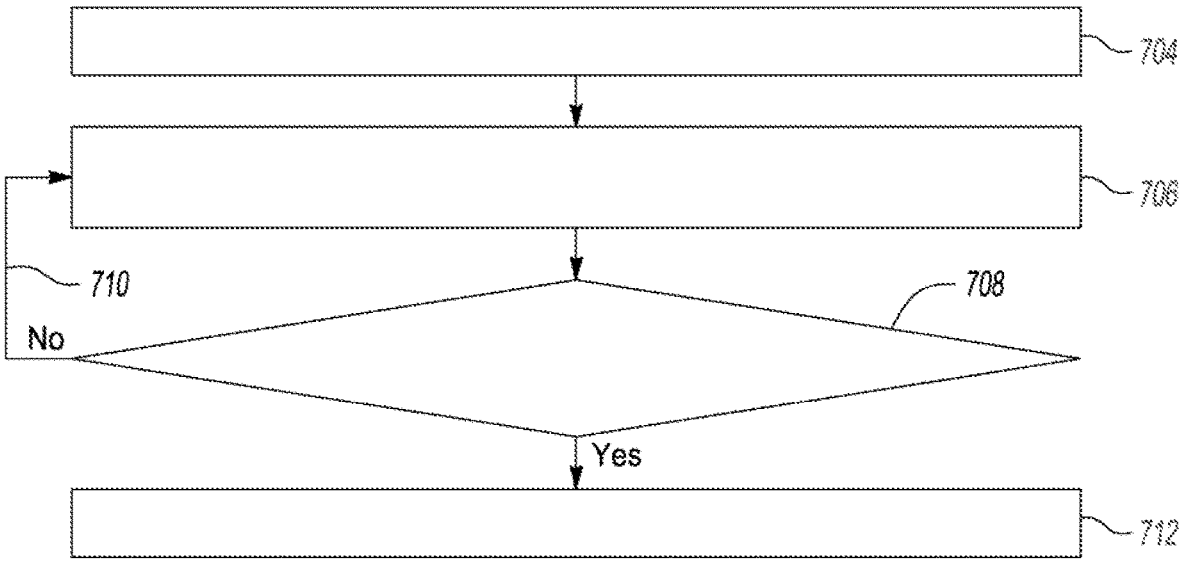

Referring to FIGS. 25 and 26, another method of operating the actuatable mechanism is provided. The method includes the step of 700 receiving a trigger command signal from an external motor controller 300. The method continues with the step of 702 transitioning to a local latch control mode to operate the actuatable mechanism independently of further command from the external motor controller 300 in response to receiving the trigger command signal.

The step of 700 receiving a trigger command signal from an external motor controller 300 can include 704 receiving the secondary driving signal 312 from the external motor controller 300. The method can continue with the step of 706 operating a primary motor driving circuit 304 coupled to a release electric motor 46, 101 of the actuatable mechanism for a predetermined amount of time independent of a duration of the secondary driving signal 312. Next, 708 determining whether the actuatable mechanism is released before the expiration of the predetermined amount of time. The next step of the method is 710 returning to the step of operating the primary motor driving circuit 304 coupled to the release electric motor 46, 101 of the actuatable mechanism in response to determining that the actuatable mechanism is not released before the expiration of the predetermined amount of time. The method proceeds by 712 stopping control of the release electric motor 46, 101 by the primary motor driving circuit 304 in response to determining that the actuatable mechanism is released before the expiration of the predetermined amount of time.

The method can additionally include the step of enabling a primary controller 60 to control the primary motor driving circuit 304 to drive the release electric motor 46, 101 for the predetermined amount of time independent of the duration of the secondary driving signal 312 using a timer circuit 600 coupled to the external motor controller 300 and the primary motor driving circuit 304 and configured to receive the secondary driving signal 312. Specifically, the method can continue with the step of charging a timer capacitor 612 of the timer circuit 600 with the secondary driving signal 312 through a timer resistor 610 of the timer circuit 600 connected to a first release output of the external motor controller 300. The method then includes the step of comparing a capacitor voltage of the timer capacitor 612 at a noninverting input 604 of a comparator 602 to a power supply voltage of a power supply 326 at an inverting input 606 of the comparator 602. The next step of the method is outputting a digital one at the comparator output 608 in response to the capacitor voltage being greater than the power supply voltage. Next, outputting a digital zero at the comparator output 608 in response to the capacitor voltage being less than the power supply voltage. The method also includes the step of providing a timer output signal delayed by the predetermined amount of time using a timer switch 614 connected to the comparator output 608.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A closure latch assembly for a closure panel of a motor vehicle, comprising:

a latch mechanism operable in a first state to locate the closure panel in a first position and in a second state to locate the closure panel in a second position;

a power actuator including an actuatable mechanism having an electric motor having a release motor shaft, the actuatable mechanism being operable in a non-actuated state to permit the latch mechanism to operate in its first state and in an actuated state to shift the latch mechanism from its first state into its second state, the electric motor being operable to drive the release motor shaft in one of an actuation direction for causing the actuatable mechanism to shift from its non-actuated state into its actuated state and a reset direction so as to reset the actuatable mechanism from its actuated state to its non-actuated state;

a primary motor driving circuit and a secondary motor driving circuit each coupled to the electric motor for independently driving the electric motor;

a primary controller coupled to the primary motor driving circuit and configured to monitor a secondary driving signal and control the primary motor driving circuit; and an isolation logic unit coupled to the primary and secondary motor driving circuits and the primary controller and an external motor controller and configured to isolate the primary motor driving circuit from the secondary motor driving circuit in response to the external motor controller controlling the secondary motor driving circuit with the secondary driving signal to prevent the secondary motor driving circuit from driving the electric motor.

2. The closure latch assembly as set forth in claim 1, wherein the actuatable mechanism is a latch release mechanism that is operable in its non-actuated state to maintain the latch mechanism in either of its first (latched) state and its second (unlatched) state, wherein the latch release mechanism is further operable in its actuated state to mechanically shift the latch mechanism from its latched state into its unlatched state, wherein the latch mechanism is operable in its latched state to hold the closure panel in its first (closed) position and is further operable in its unlatched state to permit movement of the closure panel to its second (open) position.

3. The closure latch assembly as set forth in claim 2, wherein the latch mechanism includes a ratchet and a pawl, the ratchet being moveable between a striker release position whereat a striker fixed to a vehicle body is displaced from engagement with the ratchet and a striker capture position whereat the ratchet retains and holds the striker, the ratchet being biased toward its striker release position, the pawl being moveable between a ratchet releasing position whereat the ratchet is permitted to move toward its striker release position and a ratchet holding position whereat the pawl holds the ratchet in its striker capture position, the pawl being biased toward its ratchet holding position, the latch mechanism is operating in its unlatched state when the ratchet is located in its striker release position and is operating in its latched state when the ratchet is held in its striker capture position, wherein the latch release mechanism includes a release cam rotatably driven by the electric motor between a home position whereat the pawl is maintained in its ratchet holding position and a pawl release position whereat the pawl moves to its ratchet releasing position, the latch release mechanism is operating in its non-actuated state when the release cam is located in its home position and is operating in its actuated state when the release cam is located in its pawl release position, wherein a movement of the release cam from its home position to its pawl release position is caused by rotation of the release motor shaft of the electric motor in the actuation direction for providing a power release function, and another movement of the release cam from its pawl release position to its home position is caused by rotation of the release motor shaft in the reset direction for providing a powered reset function.

4. The closure latch assembly as set forth in claim 3, further including a power lock actuator including a lock electric motor for controlling a connection between an inside release lever and a pawl release lever operatively connected to the pawl.

5. The closure latch assembly as set forth in claim 4, wherein the lock electric motor includes a first lock motor terminal and a second lock motor terminal and wherein the external motor controller includes a first lock output coupled to the second lock motor terminal and a second lock output coupled to the first lock motor terminal and the lock electric motor is configured to be driven by the by one of the second lock output and a second release output of the external motor controller.

6. The closure latch assembly as set forth in claim 1, wherein the external motor controller includes a first release output and a second release output and the electric motor includes a first release motor terminal and a second release motor terminal and the primary controller includes a low side output and a high side output and the primary motor driving circuit includes:

a primary high side switch coupled to a power supply and to the second release motor terminal and controlled by one of the high side output of the primary controller and the isolation logic unit, and a primary low side switch coupled to an electrical ground and the first release motor terminal and controlled by one of the low side output of the primary controller and the isolation logic unit; and the secondary motor driving circuit includes:

a secondary high side switch coupled to the external motor controller and to the second release motor terminal and controlled by one of the second release output and the isolation logic unit, and a secondary low side switch coupled to the first release output and the first release motor terminal and controlled by one of the first release output and the isolation logic unit.

7. The closure latch assembly as set forth in claim 6, wherein the isolation logic unit includes:

a first primary disable switch coupled to the electrical ground and a primary high side enable input of the primary high side switch and controlled by the first release output of the external motor controller for grounding the primary high side enable input of the primary high side switch to disable the primary high side switch in response to the external motor controller providing the secondary driving signal to the secondary motor driving circuit;

a second primary disable switch coupled to the electrical ground and to the low side output of the primary controller and controlled by the first release output of the external motor controller for grounding the low side output of the primary controller to disable the primary low side switch in response to the external motor controller providing the secondary driving signal to the secondary motor driving circuit;

a second secondary enable switch coupled to the first release output and the secondary high side switch and controlled by the second primary disable switch for turning on the secondary high side switch and coupling the second release output of the external motor controller to the second release motor terminal to enable the external motor controller to operate the electric motor in response to the external motor controller providing the secondary driving signal to the secondary motor driving circuit; and a first secondary enable switch coupled to the electrical ground and the secondary low side switch and controlled by the first primary disable switch for turning on the secondary low side switch and coupling the first release output of the external motor controller to the first release motor terminal to enable the external motor controller to operate the electric motor in response to the external motor controller providing the secondary driving signal to the secondary motor driving circuit.

8. The closure latch assembly of claim 7, wherein:

the primary high side switch is an integrated high side power switch including a supply voltage input coupled to the power supply and a ground input coupled to the electrical ground and the primary high side enable input coupled to the first primary disable switch and an output coupled to the second release motor terminal;

the primary low side switch is a field effect transistor including a primary low source coupled to the electrical ground and a primary low drain coupled to the first release motor terminal and a primary low gate coupled to the low side output of the primary controller;

the secondary high side switch is a field effect transistor including a secondary high source coupled to the second release output of the external motor controller and a secondary high drain coupled to the second release motor terminal and a secondary high gate coupled to the second secondary enable switch and the second release output of the external motor controller; and the secondary low side switch is a field effect transistor including a secondary low source coupled to the first release output of the external motor controller and a secondary low drain coupled to the first release motor terminal and a secondary low gate coupled to the first secondary enable switch and to the first release output of the external motor controller.

9. The closure latch assembly of claim 8, wherein:

the first primary disable switch is a bipolar junction transistor including a first primary disable emitter coupled to the electrical ground and first primary disable collector coupled to the primary high side enable input of the primary high side switch and a first primary disable base coupled to the first release output of the external motor controller;

the second primary disable switch is a bipolar junction transistor including a second primary disable emitter coupled to the electrical ground and a second primary disable collector coupled to the low side output of the primary controller and a second primary disable base coupled to the first release output of the external motor controller;

the first secondary enable switch is a bipolar junction transistor including a first secondary enable emitter coupled to the electrical ground and a first secondary enable collector coupled to the secondary low gate of the secondary low side switch and a first secondary enable base coupled to the first primary disable collector of the first primary disable switch; and the second secondary enable switch is a bipolar junction transistor including a second secondary enable emitter coupled to the first release output and a second secondary enable collector coupled to the secondary high gate of the secondary high side switch and a second secondary enable base coupled to the second primary disable collector of the second primary disable switch and the low side output of the primary controller.

10. The closure latch assembly of claim 6, wherein the primary high side switch further includes a current sense output and the primary controller includes a current sense input coupled to the current sense output of the primary high side switch for sensing an amount of current supplied to the electric motor when the primary high side switch drives the electric motor.

* * * * *